United States Patent [19]

Abe et al.

[11] Patent Number: 5,077,179

[45] Date of Patent: Dec. 31, 1991

[54] METHOD FOR PROCESSING SILVER HALIDE PHOTOSENSITIVE MATERIAL HAVING A CONTROLLED AMOUNT OF CALCIUM AND INCLUDING THE REPLENSHING OF WASHING WATER

[75] Inventors: Akira Abe; Yoshihiro Fujita; Nobuo Sakai, all of Minami-Ashigara, Japan

[73] Assignee: Fuji Photo Film Co., Ltd., Minami-Ashigara, Japan

[21] Appl. No.: 106,425

[22] Filed: Oct. 9, 1987

[30] Foreign Application Priority Data

Oct. 13, 1986 [JP] Japan ..... 61-242713

[51] Int. Cl.[5] ..... G03C 5/395

[52] U.S. Cl. ..... 430/372; 430/398; 430/401; 430/421; 430/463; 430/490; 430/491; 430/428

[58] Field of Search ..... 430/401, 491, 421, 463, 430/393, 430, 467, 490, 372, 398, 428

[56] References Cited

U.S. PATENT DOCUMENTS

| | | | |
|---|---|---|---|
| 2,193,015 | 3/1940 | Weissberger | 430/470 |
| 2,592,364 | 4/1952 | Weissberger et al. | 430/470 |
| 3,189,454 | 6/1965 | Luckey et al. | 430/401 |
| 3,462,269 | 8/1969 | Tassone | 430/467 |
| 3,647,461 | 3/1972 | Surash et al. | 430/467 |
| 3,647,462 | 3/1972 | Surash et al. | 430/467 |
| 4,264,716 | 4/1981 | Vincent et al. | 430/467 |
| 4,336,324 | 6/1982 | Koboshi et al. | 430/421 |
| 4,584,266 | 4/1986 | Hirose et al. | 430/555 |
| 4,855,218 | 8/1989 | Fujita et al. | 430/428 |
| 4,873,179 | 10/1989 | Abe et al. | 430/382 |

OTHER PUBLICATIONS

C. R. Dupree, "Practical Operation of Ion Exchange Equipment for Photographic Wash Water Purification" Photographic Engineering vol. 2, No. 3, 1951, pp. 110–115.

M. P. Gregor, "Application of Ion Exchange Resins in Photographic Processing" Photographic Engineering, vol. 2 No. 3 1951 pp. 102–109.

J. H. Priesthoff "Improved Technique for Ion-Exchange Recovering of Eastman Color Developers" Journal of SMPTE vol. 66 Feb. 1957 pp. 64–65.

The Quality of Water for Photographic Processing, Lloyd E. West, Photgr Science and Engineering, vol. 3, No. 6, Nov.-Dec. 1959, p. 283.

Goldwasser, SMPTE Journal, "Water Flow Rates in Immersion Washing of Motion Picture Film" May 1955.

*Primary Examiner*—Charles L. Bowers, Jr.

*Assistant Examiner*—Lee C. Wright

*Attorney, Agent, or Firm*—Burns, Doane, Swecker & Mathis

[57] ABSTRACT

A method for processing silver halide photosensitive materials comprises replenishing each of replenishers to water washing process and/or stabilization process in an amount of 1 to 50 times the volume of a solution carried over from a bath preceding the water washing process and/or the stabilization process per unit area of the photosensitive material and limiting the amount of calcium compounds included in a layer for constituting photograph of the photosensitive material to not more than 25 mg/m$^2$ on the basis of the weight of elemental calcium. The method makes it possible to effectively suppress the contamination of the processed photosensitive materials, the increase in turbidity of the water washing and/or stabilization bath solutions and the proliferation of bacteria or molds in these baths. These effects are further enhanced by reducing the amount of calcium and magnesium present in the replenishers for washing and/or stabilization.

15 Claims, No Drawings

METHOD FOR PROCESSING SILVER HALIDE PHOTOSENSITIVE MATERIAL HAVING A CONTROLLED AMOUNT OF CALCIUM AND INCLUDING THE REPLENSHING OF WASHING WATER

CROSS-REFERENCE OF THE RELATED APPLICATION

This application is related to the application Ser. No. 057,254 filed on June 3, 1987 assigned to the same assignee of this application.

BACKGROUND OF THE INVENTION (1) Field of the Invention

The present invention relates to a method for processing silver halide photosensitive materials and in particular to an improved processing method which makes it possible to greatly reduce the amount of water used in the processing without impairing the properties of the photosensitive materials to be processed.

(2) Prior Art

Recently, efforts have been directed to reducing the amount of water used in processes included in the method for processing silver halide photosensitive materials, such as the water washing process from, the viewpoint of environmental protection, preservation of the water resources and enhanced economy. For example, one such technique for reducing the amount of washing water is proposed by S. R. Goldwasser in his article entitled "Water Flow Rates in Immersion-Washing of Motion Picture Film", Journal of the Society of Motion Picture and Television Engineers, Vol. 64, 248–253 (May, 1955) in which saving of washing water is achieved by employing a multistage washing system including the use of a plurality of washing tanks and countercurrently passing water therethrough. Likewise, U.S. Pat. No. 4,336,324 discloses another method comprising directly transferring bleached and fixed photosensitive materials to stabilization process without substantially passing them through washing process to save washing water. These methods have been adopted in different kinds of automatic processors as an effective means for water saving.

However, there is a limit to the amount of water which can be saved by the foregoing methods. For example, it has gradually become clear that if the amount of a replenisher replenished to the water washing process and/or the stabilization process is reduced to not more than 50 times the volume of liquid carried over by the photosensitive materials from a bath preceding the water washing and/or the stabilization baths per unit area thereof and the processing is continued for a long period of time, various kinds of suspended materials are gradually accumulated in the water washing and/or the stabilization baths and they adhere to the surface of the photosensitive materials to cause contamination thereof which in turn impair the quality of the processed photosensitive materials.

Moreover, the baths for water washing or stabilization in such conditions are quite favorable to the proliferation of bacteria or molds which also adhere to the photosensitive materials and promote the contamination thereof. The proliferation of bacteria or molds further causes rapid clogging of circulating pumps and filters set up on the baths for water washing and stabilization and gives rise to a bad smell.

Accordingly, in order to solve the aforementioned problems, Japanese Patent Un-examined Publication Nos. 61-43741 and 61-43749 propose a method comprising employing a stabilization bath, the surface tension of which is controlled in order to prevent the contamination of the photosensitive materials. However, no practical effects can be expected from this method.

On the other hand, there have been proposed various method which use a variety of antibacterial agents or antifungus agents or chelating agents for preventing the contamination of the photosensitive materials due to the proliferation of bacteria or molds (see Japanese Patent Unexamined Publication Nos. 57-8542, 57-58143 and 58-105145).

However, a sustained inhibitory effect of preventing the proliferation of bacteria or molds cannot be obtained by these methods. If a large amount of such agents is used to achieve such effects for a long period of time, this makes the processed photosensitive materials quite sticky and the materials are liable to adhere to one another or to other materials. Thus, there has not yet been proposed a method for processing silver halide photosensitive materials, which can completely eliminate the foregoing problems.

SUMMARY OF THE INVENTION

Under such circumstances, the inventors of this invention have conducted various studies toward elimination of the aforementioned drawbacks associated with the conventional methods for processing silver halide photosensitive materials and to develop an improved processing method which permits the complete elimination of such disadvantages and a substantial saving of washing water.

Accordingly, it is a primary object of the present invention to provide a method for processing silver halide photosensitive materials which makes it possible to substantially save washing water without causing contamination of the photosensitive materials during processing.

It is another object of the present invention to provide a processing method capable of preventing the accumulation of various kinds of suspended materials in baths for water washing or stabilization and the clogging of equipment such as pumps connected to the baths because of the proliferation of bacteria or molds.

It is a further object of the present invention to provide a sanitary processing method in which baths for water washing or stabilization do not give off a smell at all.

These and other objects of the present invention will be apparent from the following description.

The inventors of the present invention found out the fact that the foregoing drawbacks of the conventional methods for processing silver halide photosensitive materials can effectively be eliminated by limiting the amount of calcium compounds included in a layer for constituting photograph per 1 $m^2$ of the photosensitive materials to not more than 25 mg on the basis of elemental calcium. In addition, in case where the photographic material contains a large amount of calcium compounds, scale is adhered to the turn roller of the processor and thereby the photographic material is damaged, but such damage can be settled by limiting the amount of calcium compounds as described above. The present invention has been completed on the basis of these findings.

In accordance with the present invention, there is provided a method for processing silver halide photosensitive materials which comprises replenishing each of solutions to water washing process and/or stabilization process in an amount of 1 to 50 times the volume of a solution carried over by the photosensitive materials from a bath preceding the water washing bath and/or the stabilization bath per unit area thereof and limiting the amount of calcium compounds included in a layer for constituting photograph per 1 $m^2$ of the photosensitive materials to not more than 25 mg on the basis of elemental calcium.

DESCRIPTION OF THE PREFERRED EMBODIMENTS

In the present invention, the term "layer for constituting photograph (hereunder referred to as photograph constituting layer)" means all the portions for forming and maintaining images applied to the surface of a support and the layer specifically includes silver halide emulsion layers, intermediate layers, protecting layers and the like.

In addition, "water washing process" means a process for reliably maintaining the properties of the processed photosensitive materials such as image-retention properties and physical properties of films by washing out components of processing solutions deposited on or absorbed in the photosensitive materials and components constituting the materials which become useless during the processing as well as that for reducing the contamination of a bath with components of the preceding bath and thus maintaining a desired quality of the bath concerned if there are succeeding bath. Therefore, the water washing process according to the present invention includes any processes capable of attaining the foregoing washing effects irrespective of the composition thereof.

The water washing process in general includes intermediate water washing arranged between any two neighboring processings and final water washing effected as the final step. The method of the present invention can be applied to both of these water washing processes.

In addition, the "stabilization process" means, in this invention, a process capable of imparting image stabilization effect to the photosensitive matrials which cannot be attained by the water washing process and the stabilization bath used in the process comprises a compound having image stabilization effect.

Examples of such a bath include those containing an aldehyde compound such as formalin which permits the deactivation of the remaining couplers and a pH buffering agent and/or an ammonium compound for adjusting pH of the film surface after processing to a range favorable to the retention of images, for instance, 4 to 6.

Not all the baths containing these components are, of course, stabilization baths, and the stabilization baths should have an image stabilization effect.

Although, it is desirable that the stabilization process be carried out as the final stage, there can optionally be carried out post-treatments such as rinsing for a short period of time so as not to impair the acquired image stabilization effect of the photosensitive materials.

The stabilization process may be carried out in place of the water washing process or subsequent to the water washing process.

In the present invention, the amount of the replenishers for water washing and/or stabilization processes ranges from 1 to 50 times the volume of a solution carried over by the processed silver halide photosensitive material from a preceding bath per unit area of the photosensitive material, preferably 3 to 30 times and particularly preferably 5 to 20 times. These processes desirably comprise a plurality of baths, preferably 2 to 6 baths and .more preferably 2 to 4 baths.

In this connection, the term "the volume of a solution carried over from the preceding bath" herein means the volume of the solution of the preceding bath which is deposited on or absorbed by the photosensitive materials and is carried over to the water washing or stabilization bath. This can be estimated by immersing, in water, the photosensitive material collected immediately before entering into the water washing or stabilization bath to extract the components of the solution carried over from the preceding bath and determining the concentration thereof in the extract.

In the present invention, the term "calcium compounds contained in the photograph constituting layer of the photosensitive material" includes all those present therein in a variety of forms such as ions, salts and complexes. The intended effect of the present invention can reliably be achieved by controlling the amount thereof to not more than 25 mg/$m^2$ on the basis of the weight of elemental calcium, preferably not more than 10 mg/$m^2$ and more preferably 3 mg/$m^2$ or less.

The quantitative analysis of the amount of calcium included in the photograph constituting layer of the photosensitive material is desirably effected according to ICP (Inductively Coupled Plasma) emission spectroscopic analysis. This analytical method is detailed in KAGAKU NO RYOIKI (Field of Chemistry), extra number 127, p. 133, 1980, published by NANKODO.

Gelatin used in the silver halide photosensitive material as a binder in general contains a considerable amount of calcium salts (eg., 3000 to 8000 ppm) originating from calcium phosphate which constitutes bones of cattle or the like as the starting material thereof and the amount thereof varies dependent upon the kinds of the raw materials, methods for processing such as deliming.

Thus, unexpectedly the present invention makes it possible to solve the problems associated with the water saving method for processing photosensitive materials by limiting the amount of calcium compounds included in the photograph constituting layer in such a wide range to 25 mg/$m^2$ or less on the basis of the weight of elemental calcium.

The following methods may be employed to control the amount of such calcium compounds included in the photograph constituting layer of the silver halide photosensitive material:

(i) A method which uses gelatin having a low calcium content when manufacturing the photosensitive material;

(ii) A method which comprises previously desalting additives containing gelatin such as gelatin solution, emulsions and silver halide emulsions according to the Nudel washing, dialysis technique or the like when manufacturing a photosensitive material.

The method (i) is preferred in view of assuring the stable properties of the photosensitive material. The calcium content of gelatin is, in general, 2000 ppm or more (limed gelatin) and 1000 ppm or more (acid-treated gelatin). The deionized gelatin having a low calcium content (100 ppm or less) can be obtained from these gelatins by passing them through a column packed with an Na+-type or H+-type cation exchange resin. Moreover, any gelatin of a low calcium content may effectively be used in the present invention irrespective of the kinds of the treatments such as dialysis.

Gelatin is herein used in various forms such as silver halide emulsions, emulsions containing couplers or a gelatin solution as a simple binder when preparing photosensitive materials. Therefore, the photosensitive materials of the present invention may be produced by appropriately employing gelatin of a low calcium content in whole or part of these additives.

The intended effects of the present invention may further be enhanced by reducing the concentrations of calcium and magnesium compounds in replenishers for water washing and/or stabilization processes to 5 mg/1 or less on the basis of the weight of elemental calcium and magnesium, respectively. Therefore, the calcium and magnesium contents of the replenishers for water washing and stabilization processes are preferably limited to 5 mg/1 or less, more preferably to not more than 3 mg/1 and most preferably to 1 mg/1 or less.

The content of calcium and magnesium in the replenishers for water washing and stabilization processes can be controlled so as to be within the aforementioned range by any known method. Examples of such methods include techniques utilizing ion exchange resins, zeolite and an apparatus for reverse osmosis. Besides these, means for deionization or for reducing the concentration thereof may also be applied to the water washing and stabilization solutions. For instance, these solution may be circulated while bringing them into contact with an ion exchange resin.

Various ion exchange resins may be used and preferred are Na-type ion exchange resins capable of exchanging Ca and Mg with Na. In addition, H-type cationic ion exchange resins may also be used. However, in this case, it is preferable to use the resin together with an OH-type anion exchange resin since the pH of the processed water becomes acidic when H-type one is used alone.

Chelating resins of aminocarboxylic acid type may also be used in place of the aforementioned cation exchange resins.

Preferred ion exchange resins are strong acidic cation exchange resins which are mainly composed of styrenedivinylbenzene copolymer and have sulfonic groups as the ion exchange group. Examples of such an ion exchange resin include Diaion SK-1B or Diaion PK-216 (manufactured and sold by MITSUBISHI CHEMICAL INDUSTRIES LTD.). The basic copolymer of these ion exchange resins preferably comprises 4 to 16% by weight of divinylbenzene on the basis of the total charge weight of monomers at the time of preparation. Moreover, preferred examples of anion exchange resins which may be used in combination with H-type cation exchange resins are strong basic anion exchange resins which mainly comprise styrenedivinylbenzene copolymer and have tertiary amino or quaternary ammonium groups as the ion exchange group. Concrete examples thereof include Diaion SA-10A or Diaion PA-418 (also, manufactured and sold by MITSUBISHI CHEICAL INDUSTRIES LTD.).

Any known methods may be employed when calcium and magnesium ions included in the replenishing solutions are removed with these ion exchange resins. However, it is preferred to pass them through a column packed with such an ion exchange resin. The flow rate of the replenishers in the column is in general 1 to 100 times the volume of the resin packed therein per hour, preferably 5 to 50 times.

Zeolites usable in the present invention are water-insoluble aluminum silicates represented by the following general formula:

$$(NaAlO_2)_x—(SiO_2)_y—Z(H_2O)$$

In the present invention, A-type zeolites having the above general formula in which x is equal to y and X-type zeolites in which x is different from y may be used. In particular, X-type zeolites are preferred because of their high ion exchange capacity with respect to both calcium and magnesium. An example of such a zeolite includes molecular sieve LINDE ZB300 (manufactured and sold by Union Carbide Corp.). Zeolites having different grain sizes are known. However, those having a grain size of more than 30 mesh are preferred when packing them in a column and coming them into contact with these replenishers.

Any types of apparatuses for reverse osmosis may be used in the method of the present invention to control the content of calcium and magnesium compounds in the replenishers and the membrane for reverse osmosis installed in the apparatus therefor includes, for instance, membranes of cellulose acetate, ethylcellulose-polyacrylic acid, polyacrylonitrile, polyvinylene carbonate and polyether sulfone.

The pressure for passing the replenishers through the membrane usually falls within the range of from 5 to 60 $kg/cm^2$. However, it is sufficient to use the pressure of not more than 30 $kg/cm^2$ to achieve the purposes of the present invention and a so-called low-pressure reverse osmotic apparatus driven at a pressure of 10 $kg/cm^2$ or less is also usable in the present invention effectively.

The membrane for reverse osmosis may be in any shape or structure such as spiral, tubular, hollow fiber, pleated or rod-shaped.

In the present invention, the replenishers replenished to the water washing process and/or the stabilization process (hereunder referred to as "replenisher for washing" and "replenisher for stabilization" respectively) are preferably sterilized before using.

The sterilization may be effected by, for instance, the addition of an antibacterial agent to these replenishers, the filtration of them through a filter of not more than 0.8 microns in pore size, the application of heat or the irradiation of them with ultraviolet rays. Among these, the addition of an antibacterial agent is preferred in order to certainly attain the intended effect of the invention. Examples of such antibacterial agents include hypochlorous acid, dichloroisocyanuric acid, trichloroisocyanuric acid and compounds which release active halogen atoms such as salts of the foregoing acids; isothiazolone type compounds such as 5-chloro-2-methyl-4-isothiazolin-3-one and 2-methyl-4-isothiazolin-3-one; benzoisothiazolone type compounds such as 1,2-benzoisothiazolin-3-one; triazole compounds such as benzotriazole; compounds which release silver ions such as silver nitrate and silver oxide; sulfanilamide; 10,10'-oxybisphenoxyarsine and those disclosed in Bokin Bobaizai No Kagaku (Chemistry of Antibacterial and Mold Control Agents), Hiroshi HORIGUCHI, Society of Hygienic Engineerings, entitled Techniques for Sterilization, Pasteurization and Mold Control. These antibacterial agents may be used in an amount of 1 to 1000 mg/1, preferably 1 to 100 mg/1 and more preferably 3 to 30 mg/1.

Particularly preferred are compounds releasing active halogen atoms in the replenisher for washing and isothiazolone type compounds in the replenisher for stabilization from the viewpoint of their effects, i.e., low influence on the photosensitive materials and easiness of handling.

To the baths for water washing and/or stabilization of the present invention, there may be added a chelating agent having a stabilization constant of not less than 6 with respect to calcium and magnesium. In this connection, the stabilization constant ($K_{MA}$) is defined as follows:

$$KMA = \frac{(MA)}{(M)(A)}$$

wherein (MA) is the molar concentration of a metal chelate, (M) the molar concentration of the metal ion and (A) the molar concentration of an anion of the chelating agent.

The chelating agent having such a stabilization constant may be selected from the group consisting of chelating compounds disclosed in the article of K. UENO, Metal Chelates III, published by NANKODO; Comprehensive Catalogue of Dotite Reagents, 13th ed., published by Dojin Chemical Lab.; and the article of L.G. Sillen et al., Stability Constant of Metal Complex, published by CHEMICAL Society, 1964. Concrete examples thereof include the following compounds:

| Compound | Stabilization Constant Ca | Mg |
|---|---|---|
| Ethylenediaminetetraacetic acid (EDTA) | 10.85 | 8.69 |
| Cyclohexanediaminetetraacetic acid (GDTA) | 12.08 | 10.32 |
| Diethylenetriaminepentaacetic acid (DTPA) | 10.74 | 9.3 |
| Hydroxyethylethylenediamine-triacetic acid (EDTA-OH) | 8.14 | 7.0 |
| Triethylenetetraminehexaacetic acid (TTHA) | 10.06 | 8.47 |
| Diaminopropanoltetraacetic acid (DPTA-OH) | 6.60 | 8.96 |
| 1,2-Diaminopropanetetraacetic acid (Methyl-EDTA) | 11.47 | 10.29 |
| Ethylenediaminetetramethylene-phosphonic acid (EDTPO) | 6.93 | 12.70 |
| Ethylenediamine-N,N'-diacetic acid-di(2-propionic acid) | 10.74 | 9.41 |
| 1,3-Diaminopropanetetraacetic acid | 7.21 | 6.02 |

Such a chelating agent makes it possible to further enhance the intended effects of the present invention and is used in an amount of from $3\times10^{-4}$ to $3\times10^{-2}$ moles/1, preferably from $1\times10^{-3}$ to $1\times10^{-2}$ mole/1.

The pH of each of baths which constitute the water washing process of the present invention is in general 5 to 9, preferably 6 to 8. On the other hand, that of the replenisher for washing replenished to these baths is 4 to 9, preferably 6 to 8. In the water washing process according to the present invention, the processing time is 20 seconds to 3 minutes, preferably 30 seconds to 2 minutes and the processing temperature is 20° to 40° C., preferably 30° to 40° C.

On the other hand, to the stabilization bath according to the present invention there is added a compound which serves to stabilize images and examples thereof include aldehyde compounds serving to deactivate residual couplers such as formaldehyde, acetaldehyde, propionaldehyde, glutaraldehyde, formaldehyde-sodium bisulfite adduct and glutaraldehyde-sodium bisulfite adduct; and compounds for controlling pH of the surface of the processed membrane such as acetic acid, boric acid, phosphoric acid, citric acid, tartaric acid and salts thereof; chelating agents, eg., aminopolycarboxylic acid, aminopolyphosphonic acid, alkylidene diphosphonic acid and phosphonocarboxylic acid and salts thereof; and various kinds of ammonium salts such as ammonium chloride, ammonium nitrate, ammonium sulfate and ammonium phosphate in an effective amount and form thereof.

The pH of each of baths which constitute the stabilization process of the present invention is in general 4 to 9, preferably 4.5 to 6.5. In addition, that of the replenisher for stabilization replenished to these baths is 4 to 9, preferably 4 to 7. Moreover, in the stabilization process, the processing time is 20 seconds to 3 minutes, preferably 30 seconds to 2 minutes and the processing temperature is 20° to 40° C., preferably 30° to 40° C.

When the water washing process and/or the stabilization process are effected subsequent to the fixing or the bleaching-fixing process, all or part of the overflow from these processes associated with the replenishment may be introduced into the fixing or bleaching-fixing process.

Besides, when the water washing or stabilization process according to the present invention is effected as the final process, a surfactant is used in these processes for the purpose of uniformly drying the processed photosensitive materials. In addition, a fluorescent whitener and a hardening agent may be added.

The method according to the present invention may widely be applied to the processing of color and monochromatic silver halide photosensitive materials and in particular to the processing of the color photosensitive materials such as color paper, color negative films, reversal color paper, reversal color films and direct positive paper.

The method for processing photosensitive materials according to the present invention will hereunder be explained with reference to, in particular, silver halide color photographic photosensitive materials as an illustrative example.

In particular, the aforementioned problems can effectively be solved if the water washing or stabilization process in the method of the present invention is carried out subsequent to the treatment having an ability of fixing. The processes for silver halide photosensitive materials to which the method of this invention can be applied are, for example, as follows:

A. color development - bleaching and fixing - water washing - drying;

B. color development water washing bleaching and fixing - water washing - drying;

C. color development - bleaching - fixing - water washing - drying;

D. color development - bleaching - bleaching and fixing - fixing - water washing - drying;

E. color development - bleaching - bleaching and fixing - water washing - drying;

F. color development fixing bleaching and fixing - water washing - drying;

G. color development - bleaching - water washing - fixing - stabilization - drying;

H. color development - bleaching - fixing - stabilization - drying;

I. color development - bleaching - bleaching and fixing - stabilization - drying;

J. color development bleaching and fixing - stabilization - drying;

K. color development fixing bleaching and fixing - stabilization - drying.

In this respect, water washing may be effected before the stabilization in the processes G to H.

Each of the processing baths will now be explained below:

Color Developing Solution

A color developing solution used for the development of the photosensitive materials of the present invention is preferably an aqueous alkaline solution containing an aromatic primary amine type color developing agent as a main component. Although, aminophenolic compounds are useful as the color developing agent, p-phenylenediamine type compounds are preferred.

Examples of the latter include 3-methyl-4-amino-N,N-diethylaniline, 3-methyl-4-amino-N-ethyl-N-beta-hydroxyethylaniline, 3-methyl-4-amino-N-ethyl-N-beta-methanesulfonamidoethylaniline, 4-amino-3-methyl-N-ethyl-N-beta-methoxyethylaniline, or sulfate, hydrochloride, phosphate, p-toluenesulfonate, tetraphenylborate and p-(t-octyl)-benzenesulfonate thereof. These diamines are generally more stable in a salt state than in a free state and, therefore, the salts are preferably used.

Examples of the aminophenol type derivatives are o-aminophenol, p-aminophenol, 4-amino-2-methylphenol and 2-amino-3-methylphenol.

In addition, those described in L.F.A. Mason, Photographic Processing Chemistry, pp. 226–229; U.S. Pat. Nos. 2,193,015 and 2,592,364 and Japanese Patent Unexamined Publication No. 48-64933 may also be used. These color developing agents may be used in combination according to need.

The color developing solution generally contains a pH buffering agent such as carbonate, borate and phosphate of alkali metals; a development restrainer or antifoggant such as bromides, iodides, benzimidazoles, benzothiazoles and mercapto compounds; a preservative such as hydroxylamine, diethyl hydroxylamine, triethanolamine, compounds described in DEOS No. 2,622,950, sulfite and hydrogen sulfite; an organic solvent such as diethylene glycol; a development accelerator such as benzylalcohol, polyethylene glycol, quaternary ammonium salts, amines, thiocyanates and 3,6-thiaoctane-1,8-diol; a dye-forming coupler; a competing coupler; a nucleus forming agent such as sodium borohydride; an auxiliary developing agent such as 1-phenyl-3-pyrazolidone; a thickener; a chelating agent such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, aminopolycarboxylic acids as described in Japanese Patent Un-examined Publication No. 58-195845, 1-hydroxyethylidene-1,1'-diphosphonic acid, organic phosphonic acids as described in Research Disclosure 18170 (May, 1979), amino phosphonic acids such as aminotris(methylenephosphonic acid) and ethylenediamineN,N,N',N'-tetramethylenephosphonic acid, and phosphonocarboxylic acids as described in Japanese Patent Unexamined Publication No. 52-102726 and Research Disclosure 18170 (May, 1979).

The color developing agent is generally used in an amount of about 0.1 to 30 g, preferably about 1 to about 15 g per liter of a color developing solution. The pH of the color developing solution is generally 7 or higher and most generally about 9 to about 13. Further, it is possible to use an auxiliary solution, in which the concentrations of halides, a color developing agent and the like are adjusted, so as to decrease the amount of a replenisher for the color developing bath.

In the method of this invention, it is preferred that the color developing solution is substantially free from benzyl alcohol listed above as an example of development accelerator. In this respect, the term "substantially free from" means that benzyl alcohol is present in the color developing solution in an amount of 2 ml or less per liter of the latter, preferably 0.5 ml or less and most preferably zero. If benzyl alcohol is not included in the color developing solution, a more excellent effect is attained.

The processing temperature in the color developing solution preferably ranges from 20° to 50° C. and more preferably from 30° to 40° C. The processing time is preferably in the range of from 20 seconds to 10 minutes and more preferably from 30 seconds to 5 minutes.

Bleaching, Bleaching-Fixing and Fixing Solutions

The photographic emulsion layers after the color development are usually subjected to a bleaching process. The bleaching may be carried out at the same time with a fixing treatment, called bleaching-fixing, or may be carried out separately.

An example of bleaching agent used in the bleaching solution or the bleaching-fixing solution employed in the present invention is a ferric ion complex which is a complex of ferric ion with a chelating agent such as aminopolycarboxylic acid, aminopolyphosphonic acid or salts thereof. The aminopolycarboxylic acid salts or aminopolyphosphonic acid salts are an alkali metal salt, ammonium salt or water-soluble amine salt of aminopolycarboxylic acid or aminopolyphosphonic acid. The alkali metal is, for instance, sodium, potassium and lithium and examples of the water-soluble amines are alkyl amines such a methylamine, diethylamine, triethylamine and butylamine; alicyclic amines such as cyclohexylamine; arylamines such as aniline and m-toluidine; heterocyclic amines such as pyridine, morpholine and piperidine.

Typical examples of the chelating agents such as aminopolycarboxylic acid and aminopolyphosphonic acid are as follows, however, it should be appreciated that the invention is not limited to the following specific examples and, for instance, various salts of the following acids such as sodium salts and ammonium salts thereof are included:

Ethylenediaminetetraacetic acid;
Diethylenetriaminepentaacetic acid;
1,3-Diaminopropanetetraacetic acids;
Cyclohexanediaminetetraacetic acid;
Iminodiacetic acid; and
Glycol ether diaminetetraacetic acid.

The ferric ion complex salt may be used in a form of one or more complex salts previously prepared or may be formed in a solution using a ferric salt, such as ferric sulfate, ferric chloride, ferric nitrate, ferric ammonium sulfate and ferric phosphate, and a chelating agent such as aminopolycarboxylic acid, aminopolyphosphonic acid and phosphonocarboxylic acid. When the complex salt is formed in a solution, one or more ferric salts may be used, and one or more chelating agents may also be used. In the case of either the previously prepared complex salt or the in situ formed one, the chelating agent may be used in an excess amount greater than that required to form the desired ferric ion salt. Among iron complexes, preferred is a complex of ferric ion with aminopolycarboxylic acid and the amount thereof used is in the range of from 0.1 to 1 mole/1, preferably 0.2 to 0.4 moles/1 in the case of bleaching solution for photographic color photosensitive materials such as color negative films. On the other hand, the compound is used in an amount of 0.05 to 0.5 moles/1, preferably 0.1 to 0.3 moles/1 in the bleaching-fixing solution therefor. Moreover, it is used in an amount of 0.03 to 0.3 moles/1, preferably 0.05 to 0.2 moles/1 in the case of the bleaching and bleaching-fixing solutions for color photosensitive materials for print such as color paper.

To the bleaching solution, bleaching-fixing solution and/or the preceding baths thereof, there may be added a bleaching accelerator according to need. Examples of useful bleaching accelerators are compounds having a mercapto group or a disulfide bond such as those disclosed in U.S. Pat. No. 3,893,858; German Patent No. 1,290,812; Japanese Patent Unexamined Publication No. 53-95630 and Research Disclosure No. 17129 (July, 1978); thiazolidine derivatives such as those disclosed in Japanese Patent Un-examined Publication No. 50-140129; isothiourea derivatives such as those disclosed in U.S. Pat. No. 3,706,561; iodides such as those disclosed in Japanese Patent Un-examined Publication No. 58-16235; polyethylene oxides such as those disclosed in German Patent No. 2,748,430; polyamine compounds such as those disclosed in Japanese Patent Publication No. 45-8836. Preferred are compounds having a mercapto group or a disulfide bond among others.

In the bleaching and bleaching-fixing solutions as used in the present invention, bromides such as potassium bromide, sodium bromide and ammonium bromide; chlorides such as potassium chloride, sodium chloride and ammonium chloride; or iodides such as ammonium iodide may be contained. If necessary, one or more inorganic or organic acids and alkali or ammonium salts thereof having a pH buffering ability, such as, boric acid, borax, sodium metaborate, acetic acid, sodium acetate, sodium carbonate, potassium carbonate, phosphorous acid, phosphoric acid, sodium phosphate, citric acid, sodium citrate and tartaric acid; anti-corrosives such as ammonium nitrate and guanidine may be added.

The fixing agent used in the fixing and bleaching-fixing solutions may be any conventional one, for instance, thiosulfates such as sodium thiosulfate and ammonium thiosulfate; thiocyanates such as sodium thiocyanate and ammonium thiocyanate; thioethers or thioureas such as ethylenebisthioglycollic acid, 3,6-dithia-1,8-octanediol, which are water-soluble, silver halide-solubilizing agents. These agents may be used alone or in combination. Further, the special bleaching-fixing solution consisting of a combination of a fixing agent and a large amount of halide such as potassium iodide described in Japanese Patent Unexamined Publication No. 51-155354 may be used in the bleaching-fixing process. In the present invention, preferred are thiosulfates, in particular, ammonium thiosulfate.

The concentration of the fixing agent in the baths for the fixing or the bleaching-fixing treatment is preferably 0.3 to 2 moles/1. In particular, in the case where photographic color photosensitive materials are processed, the amount thereof is in the range of 0.8 to 1.5 moles/1 and in the case of color photosensitive materials for print, it ranges from 0.5 to 1 mole/1.

Generally, the pH value of the fixing or bleaching-fixing solution is preferably 3 to 10, more preferably 5 to 9. In order to adjust pH, there may be added to the solutions, for example, hydrochloric acid, sulfuric acid, nitric acid, acetic acid, bicarbonates, ammonia, caustic soda, caustic potash, sodium carbonate and potassium carbonate according to need. Further, various fluorescent brighteners, defoaming agents, surfactants, polyvinylpyrrolidone or organic solvents such as methanol may also be added to the bleaching-fixing solution.

The bleaching and bleaching-fixing solutions as used herein contain a sulfite ion releasing compound, as the preservative, such as sulfites, for instance, sodium sulfite, potassium sulfite and ammonium sulfite; bisulfites, for instance, ammonium bisulfite, sodium bisulfite and potassium bisulfite; and metabisulfites, for instance, potassium metabisulfite, sodium metabisulfite and ammonium metabisulfite. These compounds are preferably present in an amount of about 0.02 to 0.5 moles/1 expressed as sulfite ions and more preferably 0.04 to 0.40 moles/1.

Furthermore, other preservatives such as ascorbic acid, carbonyl bisulfite adduct or carbonyl compounds may be used although the bisulfites are generally used as the preservative.

In addition to the foregoing compounds, it is also possible to add buffering agents, fluorescent brighteners, chelating agents and mold controlling agents according to need.

The photosensitive materials to which the foregoing processing is applied are, for instance, color paper and color negative films.

First of all, in the emulsion layer of the color paper, silver chlorobromide having a silver bromide content of 10 mole% or more is preferably used. Moreover, the silver bromide content is preferably 20 mole% or more in order to obtain an emulsion having a sufficient sensitivity without causing undesired increase in fogging and in particular when rapidity is required in color development processing the content of silver halide may be reduced to at most 10 mole% or at most 5 mole%. Particularly, the use of an emulsion having a silver bromide content of 1 mole% or less which is almost pure silver chloride is preferred since it makes the color developing process more rapid.

The photographic emulsion layer of the color negative films as used herein may contain any of the following silver halides: silver bromide, silver iodobromide, silver iodochlorobromide, silver chlorobromide and silver chloride. Preferred are silver iodobromide and silver iodochlorobromide having a silver iodide content of not more than 30 mole%. The most preferred are silver iodobromides having a silver iodide content of 2 to 25 mole%.

Use of flat grains in the silver halide photographic emulsion used in the present invention may provide enhanced sensitivity including improvement in efficiency of color sensitization by sensitizing dyes, improved relation between sensitivity and graininess, improved sharpness, improvement in progress of development, improved covering power and improved crossover. The flat silver halide grain as used herein has a ratio of diameter to thickness of 5 or more, such as 8 to 20 or 5 to 8.

Various color couplers may be incorporated in the photosensitive materials used in the present invention. The term "color coupler" hrein means a compound capable of forming a dye through coupling reaction with an oxidized form of an aromatic primary amine developing agent. Typical examples of useful color couplers include naphthol or phenol type compounds, pyrazolone or pyrazoloazole type compounds, and linear or heterocyclic ketomethylene compounds. Cyan, magenta and yellow color couplers usable in the method of the present invention are disclosed in the patents cited in Research Disclosure, 17643 (December, 1978) VII-D; and 18717 (November, 1979).

The color couplers incorporated in photosensitive materials are preferably made nondiffusible by imparting thereto ballast groups or polymerizing them. 2-Equivalent couplers which are substituted with coupling elimination groups are more preferable than 4-equivalent couplers in which a hydrogen atom is in a coupling active site, because the amount of coated silver can be decreased. Furthermore, couplers in which a formed dye has a proper diffusibility, non-color couplers, DIR couplers which release a development inhibitor through coupling reaction or couplers which release a development accelerator may also be used.

A typical yellow coupler usable in the process of the present invention is an acylacetamide coupler of an oil protect type. Examples of such yellow couplers are disclosed in U.S. Pat. Nos. 2,407,210; 2,875,057; and 3,265,506. 2-Equivalent yellow couplers are preferably used in the present invention. Typical examples of such are the yellow couplers of an oxygen atom elimination type described in U.S. Pat. Nos. 3,408,194; 3,447,928; 3,933,501; and 4,022,620, or the yellow couplers of a nitrogen atom elimination type described in Japanese Patent Publication No. 58-10739, U.S. Pat. Nos. 4,401,752 and 4,326,024, Research Disclosure 18053 (April, 1979), U.K. Patent No. 1,425,020, DEOS Nos. 2,219,917; 2,261,361; 2,329,587; and 2,433,812. Alpha-pivaloyl acetanilide type couplers are excellent in fastness, particularly light fastness, of formed dye. Alpha-benzoyl acetanilide type couplers yield high color density.

Magenta couplers usable in the method of the present invention include couplers of an oil protect type of indazolone, cyanoacetyl, or preferably 5-pyrazolone type and pyrazoloazole type ones such as pyrazolotriazole. Among 5-pyrazolone type couplers, couplers whose 3-position is substituted with an arylamino or acylamino group is preferred from the viewpoint of color phase and color density of the formed dye. Typical examples of such are disclosed in U.S. Pat. Nos. 2,311,082; 2,343,703; 2,600,788; 2,908,573; 3,062,653; 3,152,896; and 3,936,015. An elimination group of the 2-equivalent 5-pyrazolone type couplers is preferably a nitrogen atom eliminating group described in U.S. Pat. No. 4,310,619 and an arylthio group described in U.S. Pat. No. 4,351,897. The 5-pyrazolone type coupler having ballast groups described in European Patent No. 73,636 provides high color density.

As examples of pyrazoloazole type couplers, there can be listed pyrazolobenzimidazoles described in U.S. Pat. No. 3,061,432, preferably pyrazolo (5,1-c)(1,2,4) triazoles described in U.S. Pat. No. 3,725,067, pyrazolotetrazoles described in Research Disclosure 24220 (June, 1984) and Japanese Patent Un-examined Publication No. 60-33552, and pyrazolopyrazoles described in Research Disclosure 24230 (June, 1984) and Japanese Patent Un-examined Publication No. 60-43659. Imidazo (1,2-b) pyrazoles described in U.S. Pat. No. 4,500,630 is preferred on account of small yellow minor absorption of formed dye and fastness. Pyrazolo (1,5-b) (1,2,4) triazole described in U.S. Patent No. 4,540,654 is particularly preferred.

Cyan couplers usable in the method of the present invention include naphthol or phenol couplers of an oil protect type. Typical naphthol type couplers are disclosed in U.S. Pat. No. 2,474,293. Typical preferred 2-equivalent naphtholic couplers of oxygen atom elimination type are described in U.S. Pat. Nos. 4,052,212; 4,146,396; 4,288,233; and 4,296,200. Exemplary phenol type couplers are described in U.S. Pat. Nos. 2,369,929; 2,801,171; 2,772,162; and 2,895,826.

Cyan couplers which are resistant to humidity and heat are preferably used in the present invention. Examples of such are phenol type cyan couplers having an alkyl group higher than methyl group at a metha-position of a phenolic nucleus as described in U.S. Pat. No. 3,772,002; 2,5-diacylaminosubstituted phenol type couplers as described in U.S Pat. Nos. 2,772,162; 3,758,308; 4,126,396; 4,334,011; and 4,327,173; DEOS No. 3,329,729; and European Patent No. 121,365; and phenol type couplers having a phenylureido group at the 2-position and an acylamino group at the 5-position as described in U.S. Pat. Nos. 3,446,622; 4,333,999; 4,451,559; and 4,427,767. Cyan couplers in which 5-position of naphthol is substituted with a sulfonamido or amido group as described in Japanese Patent Application Nos. 59-93605, 59-264277 and 59-268135 are excellent in fastness of formed images and may also be preferably used in the method of the present invention.

In order to compensate for unnecessary absorption in the short-wave region of a dye formed from magenta and cyan couplers, it is preferred to use a colored coupler together in color photosensitive materials used for taking photographs. Examples of such are the yellow colored magenta couplers described in U.S. Pat. No. 4,163,670 and Japanese Patent Publication No. 57-39413, the magenta colored cyan couplers disclosed in U.S. Pat. Nos. 4,004,929 and 4,138,258 and U.K. Patent No. 1,146,368.

In addition to the foregoing components, the photosensitive materials as used in the method of this invention may include antioxidants, color sensitizers, ultraviolet absorbers, antidiscoloration agents for cyan, magenta and/or yellow dye images, other antidiscoloration agents, stain resistant agents, antifoggants, spectral sensitizers, dyes, hardening agents, surfactants, antistatic agents, development accelerators, desilvering accelerators and the like.

The method according to the present invention can be applied to a variety of photosensitive materials composed of the foregoing components and having various kinds of known layer structures.

The photosensitive layer is in general coated on the surface of a substrate. Examples of such substates are flexible substrates currently utilized in preparing photographic photosensitive materials such as plastic films and paper and preferred are baryta paper and paper laminated with polyethylene films in which a white pigment such as titanium oxide is incorporated. The additives and the substrates as disclosed in Research Disclosure No. 17643, pp. 23–28 and ibid, No. 18716, pp. 648–651 may also be used.

It is known that excellent photographic properties are obtained by controlling the amount of calcium compounds included in photographic photosensitive materials. For example, Japanese Patent Un-examined Publication No. 60-159850 discloses such an effect observed when a 2-equivalent magenta coupler is used in combination.

On the contrary, according to the method of the present invention, problems observed when the amount of replenishers for washing and/or stabilization is restricted to not more than a specific value are almost solved by controlling the amount of calcium compounds in the photosensitive materials and such effect is can in no way be deduced from conventional knowledge.

It is assumed, in the present invention, that the amount of calcium compounds dissolved out from the photosensitive materials during processing is restricted to not more than a desired level by limiting the content of the calcium compounds in the photograph constituting layers of the materials to not more than a desired level and that this in turn makes it possible to suppress the accumulation of suspended materials and the proliferation of bacteria and molds observed in the water-saving processings and that the contamination of the photosensitive materials or the like can thus be prevented.

The effects of the present invention are enhanced by reducing the amount of calcium compounds in the replenishers for washing and/or stabilization and they are further enhanced by simultaneously reducing the amount of magnesium compounds therein.

The present invention will hereunder be explained in more detail with reference to the following working examples. However, it is appreciated that the invention is not restricted to the following examples. Moreover, the effects practically achieved according to the method of this invention will also be discussed in comparison with comparative examples.

EXAMPLE 1

Samples (A to E) of multilayered color photographic paper having a layer structure summarized in Table I below were produced by applying, in order, coating liquids onto the surface of a paper substrate both surfaces of which were laminated with polyethylene films. The coating liquids were prepared as follows:

Preparation of Coating Liquid for 1st Layer

To 19.1 g of an yellow coupler (a) and 4.4 g of a dye image stabilizer (b) there were added 27.2 cc of ethyl acetate and 7.7 cc of solvent (c) and the resultant solution was dispersed in 185 cc of 10% aqueous gelatin solution containing 8 cc of 10% sodium dodecylbenzenesulfonate solution to form an emulsion. On the other hand, a blue-sensitive emulsion was prepared by adding the following blue-sensitive sensitizing dye to a silver chlorobromide emulsion (silver bromide content =80.0 mole%; the amount of silver=70 g/kg) in an amount of $5.0\times10^{-4}$ moles per mole of the silver chlorobromide. The emulsified dispersion and the blue-sensitive emulsion prepared above were mixed and the concentration of each component was adjusted so as to obtain a liquid having the composition described in Table I and thus the coating liquid for 1st layer was prepared. Coating liquids for second to seventh layers were also prepared according to procedures similar to those for preparing the first liquid. In each of these layers, sodium salt of 1-oxy-3,5-dichloro-s-triazine was used as a hardening agent for gelatin.

The following spectral sensitizers were used in each of the emulsions:

Blue-sensitive emulsion layer

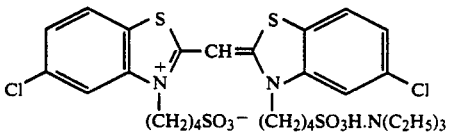

(Amount added $=5.0\times10^{-4}$ moles per mole of silver halide)

Green-sensitive emulsion layer

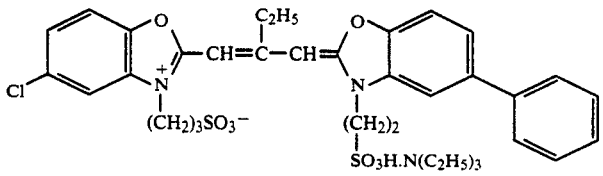

(Amount added $=4.0\times10^{-4}$ moles per mole of silver halide)

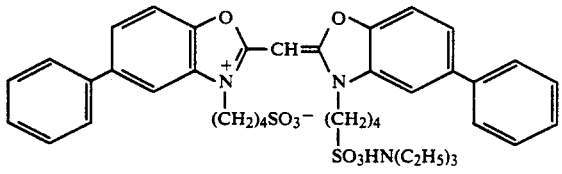

(Amount added $=7.0\times10^{-5}$ moles per mole of silver halide)

Red-sensitive emulsion layer

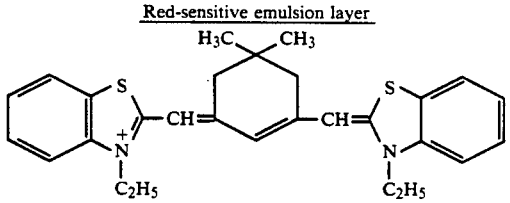

(Amount added $=0.9\times10^{-4}$ moles per mole of silver halide)

To the red-sensitive emulsion layer, the following compound was added in an amount of $2.6\times10^{-3}$ moles per mole of silver halide.

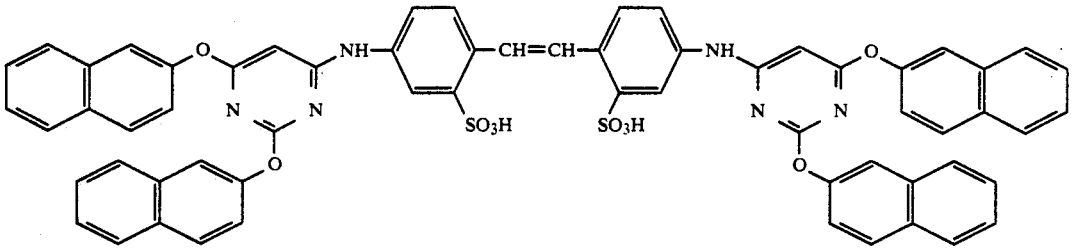

Moreover, to the blue-sensitive, green-sensitive and red-sensitive emulsion layers, 1-(5-methylureidophenyl-5-mercaptotetrazole was added in an amount of $8.5\times10^{-5}$ moles, $7.7\times10^{-4}$ moles and $2.5\times10^{-4}$ moles per mole of silver halide, respectively.

In addition, to the blue-sensitive and green-sensitive emulsion layers, 4-hydroxy-6-methyl-1,3,3a,7-tetrazaindene was added in an amount of $1.2\times10^{-2}$ moles and $1.1\times10^{-2}$ moles per mole of silver halide, respectively.

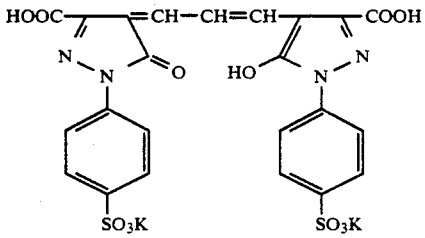

and

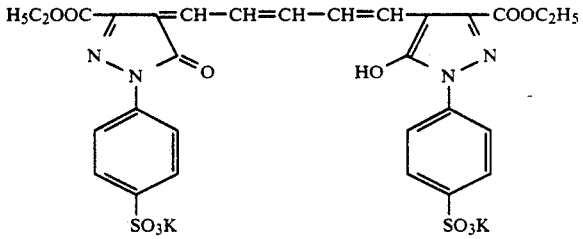

TABLE I

| Layer | Principal Components | Amount (g/m$^2$) |
|---|---|---|
| 7th layer | gelatin (for dilution) | 1.33 |
| (protective layer) | acrylic acid modified polyvinyl alcohol copolymer (degree of modification = 17%) | 0.17 |
| | liquid paraffin | 0.03 |
| 6th layer | gelatin (for dilution = 0.26; for emulsion = 0.27) | 0.53 |
| (UV absorbing layer) | UV absorber (i) | 0.21 |
| | solvent (k) | 0.08 |
| 5th layer | silver halide emulsion | 0.23 (Ag) |
| (red-sensitive layer) | gelatin (for dilution = 0.35; for emulsion = 0.75; for emulsifier = 0.24) | 1.34 |
| | cyan coupler (l) | 0.34 |
| | dye image stabilizer (m) | 0.17 |
| | polymer (n) | 0.40 |
| | solvent (o) | 0.23 |
| 4th layer | gelatin (for dilution = 0.78; for emulsion = 0.80) | 1.58 |
| (UV absorbing layer) | UV absorber (i) | 0.62 |
| | color mixing inhibitor (j) | 0.05 |
| | solvent (k) | 0.24 |
| 3rd layer | silver halide emulsion | 0.16 (Ag) |
| (green-sensitive layer) | gelatin (for dilution = 0.95; for emulsion = 0.65; for emulsifier = 0.19) | 1.79 |
| | magenta coupler (e) | 0.32 |
| | color image stabilizer (f) | 0.20 |
| | color image stabilizer (g) | 0.01 |
| | solvent (h) | 0.65 |

TABLE I-continued

| Layer | Principal Components | Amount (g/m$^2$) |
|---|---|---|
| 2nd layer (color mixing inhibiting layer) | gelatin (for dilution = 0.89; for emulsion = 0.10) | 0.99 |
| | color mixing inhibitor (d) | 0.08 |
| 1st layer (blue-sensitive layer) | silver halide emulsion | 0.26 (Ag) |
| | gelatin (for dilution = 0.89; for emulsion = 0.65; for emulsifier = 0.29) | 1.83 |
| | yellow coupler (a) | 0.83 |
| | color image stabilizer (b) | 0.19 |
| | solvent (c) | 0.35 |
| substrate | paper laminated with polyethylene (polvethylene situated at the side of the 1st layer containing a white pigment (titanium oxide) and a bluing dye (Ultramarine Blue)) | |

(a) Yellow coupler

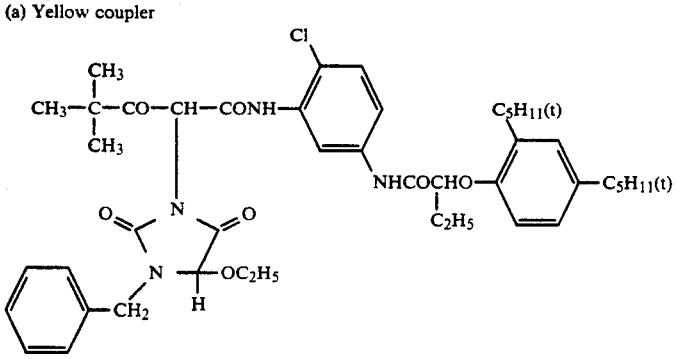

(b) Color image stabilizer

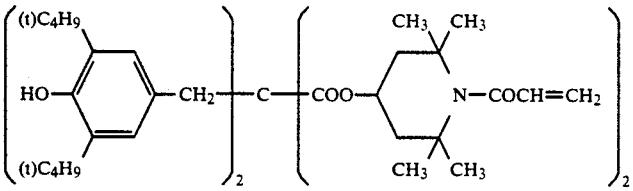

(c) Solvent

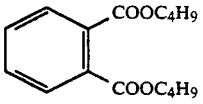

(d) Color mixing inhibitor

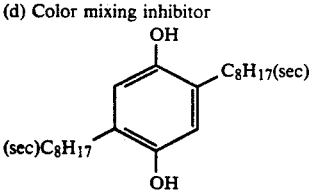

(e) Magenta coupler

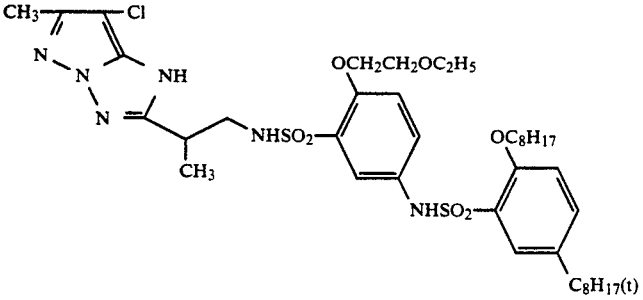

(f) Color image stabilizer

TABLE I-continued
| Layer | Principal Components | Amount (g/m²) |
|---|---|---|
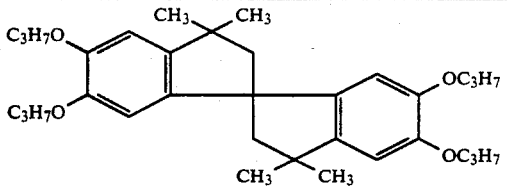
(g) Color image stabilizer
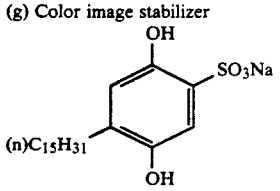
(h) Solvent
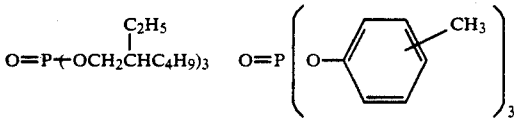
(h1) (h2)
(a 2:1 mixture (volume ratio) of $h_1$ and $h_2$)
(i) UV absorber
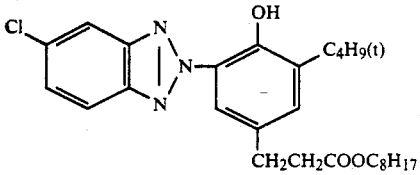
(i1)
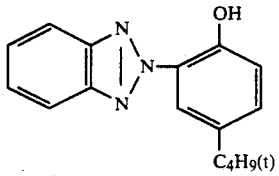
(i2)
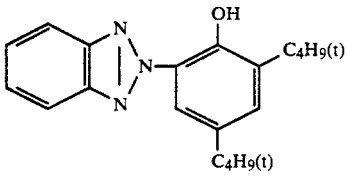
(i3)
(a 2:9:8 mixture (weight ratio) of $i_1$, $i_2$ and $i_3$)
(j) Color mixing inhibitor
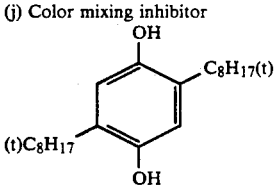
(k) Solvent
$O{=}P{\leftarrow}O{-}C_9H_{19}(iso))_3$
(l) Cyan coupler
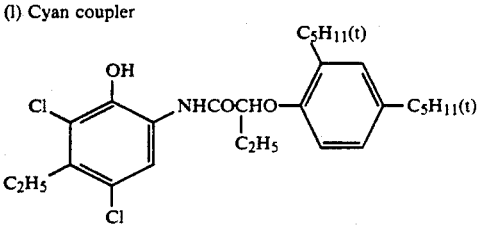

TABLE I-continued

| Layer | Principal Components | Amount (g/m²) |
|---|---|---|

(m) Color image stabilizer

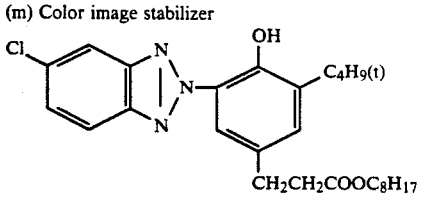

(m1)

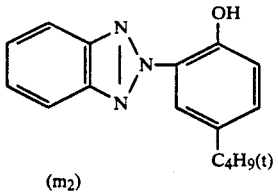

(m2)

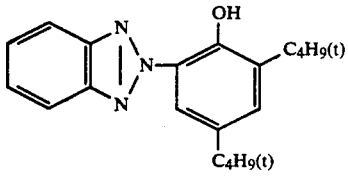

(m3)

(a 5:8:9 mixture (weight ratio) of m1, m2 and m3)

(n) Polymer

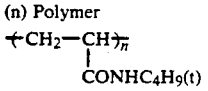

(average molecular weight = 35,000)

(o) Solvent

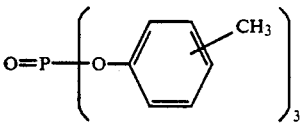

Sample A: Limed gelatin having a calcium content of 3500 ppm was used in all the layers of this Sample (calcium content of Sample A=32.9 mg/m²);

Sample B: The same as Sample A except that deionized gelatin having calcium content of 40 ppm was used as the gelatin for emulsion (calcium content of Sample B=21.7 mg/m²);

Sample C: The same as Sample A except that the aforementioned deionized gelatin was used as the whole of the galatin for emulsion and that for dilution used in the 3rd to 7th layers (calcium content of Sample C=9.0 mg/m²); Sample D:

The same as Sample A except that the foregoing deionized gelatin was used for the whole of the gelatin for emulsion and for dilution (calcium content of Sample D=2.5 mg/m²);

Sample E: All the gelatin used was the aforesaid deionized gelatin (calcium content of Sample E=0.4 mg/m²).

Samples A to E thus prepared were cut into long bandlike paper 82.5 mm in width, were exposed to light with an autoprinter and then processed by an autodeveloping machine according to the processing steps shown in Table II. The volume of the solution carried over from the preceding baths to baths for water washing process in each processing was 2.5 ml per 1 m of the processed Samples having a width of 82.5 mm.

TABLE II

| Step | Temp. (°C.) | Processing time (sec.) | Volume of tank (liter) | Amount replenished (*) |
|---|---|---|---|---|
| Color development | 38 | 75 | 16 | 13 |

TABLE II-continued

| Step | Temp. (°C.) | Processing time (sec.) | Volume of tank (liter) | Amount replenished (*) |
|---|---|---|---|---|
| Bleaching-fixing | 35 | 45 | 10 | 8 |
| Water washing (1) | 35 | 15 | 4 | Multistage countercurrent system (amount replenished: see Table III) |
| Water washing (2) | 35 | 15 | 4 | |
| Water washing (3) | 35 | 15 | 4 | |
| Drying | 80 | 50 | | |

(*) This was expressed as replenished amount in m/per 1 m of the Sample having 82.5 mm in width.

The processing solutions used in these steps had the following compositions:

| Component | Tank solution (g) | Replenishing solution (g) |
|---|---|---|
| (Color Development Solution) | | |
| Water | 800 (ml) | 800 (ml) |
| 1-Hydroxyethylidene-1,1-diphosphonic acid (60% solution) | 1.5 (ml) | 1.5 (ml) |
| Sodium sulfite | 0.2 | 0.3 |
| Potassium bromide | 0.9 | — |
| Diethylhydroxylamine | 4.2 | 5.0 |
| 1,4-diazabicyclo [2,2,2] octane | 2.0 | 2.5 |
| Potassium carbonate | 25.0 | 25.0 |
| Potassium hydroxide | 3.8 | 6.3 |
| Fluorescent brightener (stilbene type) | 1.0 | 1.5 |
| Sodium bicarbonate | 0.5 | — |
| N-Ethyl-N-(beta-methanesulfonamidoethyl)-3-methyl-4-aminoaniline sulfate | 5.5 | 7.8 |

-continued

| Component | Tank solution (g) | Replenishing solution (g) |
|---|---|---|
| Water (Amount required to obtain 1 liter of the solutions) | | |
| pH | 10.25 | 10.80 |
| (Bleaching-Fixing Solution) | | |
| Water | 700 (ml) | 700 (ml) |
| Ammonium thiosulfate solution (70% w/v) | 150 (ml) | 200 (ml) |
| Sodium sulfite | 18 | 25 |
| Ferric ammonium ethylenediamine-tetraacetate (dihydrate) | 55 | 65 |
| Ethylenediaminetetraacetic acid | 5 | 10 |
| pH (aqueous ammonia or acetic acid) | 6.75 | 6.50 |
| Water (amount required to obtain 1 liter of the solutions) | | |

(Washing Water: Tank Solution and Replenisher)

Washing water I: Tap water having the following composition:

| | |
|---|---|
| calcium | 31 mg/l |
| magenesium | 9 mg/l |
| pH | 7.2 |

Washing water II: Washing water I containing 0.02 g/l of sodium dichloroisocyanurate. Water water III: This was obtained by passing the washing water I through a column of a mixed bed type packed with H-type strong acidic cation exchange resin and OH-type strong basic anion exchange resin (manufactured and sold by MITSUBISHI CHEMICAL INDUSTRIES LTD. under the trade name of Diaion SK-1B and Diaion SA-10A, respectively) to obtain water having the following composition and then adding 0.02 g/l of sodium dichloroisocyanurae thereto:

| | |
|---|---|
| calcium | 0.9 mg/l |
| magnesium | 0.3 mg/l |
| pH | 6.7 |

Each of Samples A to E was processed using the washing water I to III. The processing was carried out at a rate of 90 m/day and such processing was continued for 2 weeks at a rate of 6 days/week.

An unexposed Sample of 10 m long was processed before commencing each final processing and the degree of contamination thereof was visually observed. On the other hand, water in the final water washing bath was taken after completion of the processing to charge it in a glass cell having a light path of 1 cm and the degree of turbidity was determined from the absorbance at 700 nm utilizing a spectrophotometer. Moreover, the degree of the proliferation of molds was inspected by immersing a simplified culture plate, Easicult-M (manufactured and sold by ORION-DIAGONOSTICA), in the final water washing bath for about 3 seconds, the cultivating at 25° C. for 48 hours and visually observing the plate. The results obtained are summarized in Table III.

TABLE III

| Test No. | Sample used | Content of Ca (mg/m$^2$) | Washing water | Amount Replenished (1) |
|---|---|---|---|---|
| 1 (*) | A | 32.9 | I | 800 |
| 2 (*) | B | 21.7 | I | 800 |
| 3 (*) | C | 9.0 | I | 800 |
| 4 (*) | D | 2.5 | I | 800 |
| 5 (*) | E | 0.4 | I | 800 |
| 6 (*) | A | 32.9 | II | 30 |
| 7 | B | 21.7 | II | 30 |
| 8 | C | 9.0 | II | 30 |
| 9 | D | 2.5 | II | 30 |
| 10 | E | 0.4 | II | 30 |
| 11 (*) | A | 32.9 | III | 30 |
| 12 | B | 21.7 | III | 30 |
| 13 | C | 9.0 | III | 30 |
| 14 | D | 2.5 | III | 30 |
| 15 | E | 0.4 | III | 30 |

| Test No. | Contamination of Sample | Turbidity of water wasing bath | Molds in water washing bath |
|---|---|---|---|
| 1 (*) | (−) | (+) | (+) |
| 2 (*) | (−) | (+) | (+) |
| 3 (*) | (−) | (+) | (+) |
| 4 (*) | (−) | (+) | (+) |
| 5 (*) | (−) | (+) | (+) |
| 6 (*) | (+++) | (+++) | (+++) |
| 7 | (+) | (+) | (+) |
| 8 | (−) | (+) | (+) |
| 9 | (−) | (+) | (+) |
| 10 | (−) | (+) | (+) |
| 11 (*) | (++) | (+) | (+) |
| 12 | (−) | (+) | (+) |
| 13 | (−) | (+) | (−) |
| 14 | (−) | (−) | (−) |
| 15 | (−) | (−) | (−) |

Explanation of Ideogranms (−) to (+++) in Table III:

| | Contamination of Sample | Turbidity of water wasing bath | Molds in water washing bath |
|---|---|---|---|
| (−) | not observed | not observed (abs. = 0.005 or less) | not observed |
| (+) | observed in small degree | observed in small degree (abs. = 0.006–0.010) | observed in small degree |
| (++) | observed in some degree | observed in some degree (abs. = 0.011–0.015) | observed in some degree |
| (+++) | observed in great degree | observed in great degree (abs. = 0.016 or more) | observed in great degree |

(1) This was expressed as replenished amount in ml per 1 m of the sample having 82.5 mm in width.

(*) This represents the comparative example.

From the results summarized in Table III, according to the method of this invention, the contamination of Samples, the turbidity of the water washing bath and the proliferation of bacteria or molds can reliably be suppressed by controlling the amount of calcium in the photosensitive materials to not more than 25 mg/m$^2$.

In Test Nos. 6 and 11, a bad smell was given off while in Test Nos. 7 to 10 and 12 to 15 according to the present invention, the proliferation of molds was suppressed and the no bad smell was detected at all.

EXAMPLE 2

Samples (F to J) of multilayered color photographic paper having a layer structure summarized in Table IV below were produced by applying, in order, coating liquids onto the surface of a paper substrate both surfaces of which were laminated with polyethylene films. The coating liquids were prepared as follows:

Preparation of Coating Liquid for 1st Layer

To 19.1 g of an yellow coupler (a) and 4.4 g of a dye image stabilizer (b) there were added 27.2 cc of ethyl acetate and 7.7 cc of solvent (c) and the resultant solution was dispersed in 185 cc of 10% aqueous gelatin solution containing cc of 10% sodium dodecylbenzenesulfonate solution to form an emulsion. On the other hand, a blue-sensitive emulsion was prepared by adding the following blue-sensitive sensitizing dye to a silver chlorobromide emulsion (silver bromide content = 1.0 mole%; the amount of silver = 70 g/kg) in an amount of $5.0\times10^{-4}$ moles per mole of the silver chlorobromide. The emulsified dispersion and the blue-sensitive emulsion prepared above were mixed and the concentration of each component was adjusted so as to obtain a liquid having the composition described in Table IV and thus the coating liquid for 1st layer was prepared. Coating liquids for second to seventh layers were also prepared according to procedures similar to those for preparing the first liquid. In each of these layers, sodium salt of 1-oxy-3,5-dichloro-s-triazine was used as a hardening agent for gelatin.

The following spectral sensitizers were used in each of the emulsions:

Blue-sensitive emulsion layer

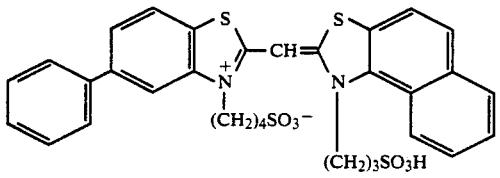

(Amount added = $5.0\times10^{31\ 4}$ moles per mole of silver halide)

Green-sensitive emulsion layer

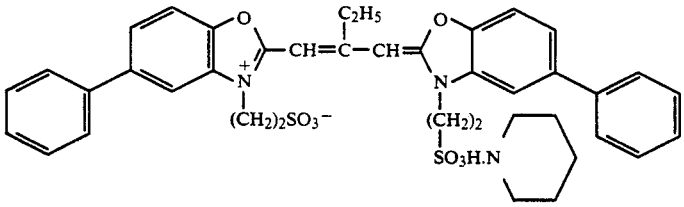

(Amount added = $4.0\times10^{4}$ moles per mole of silver halide)

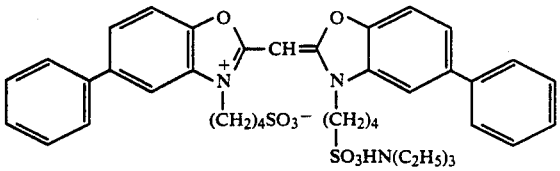

(Amount added = $7.0\times10^{5}$ moles per mole of silver halide)

Red-senstive emulsion layer

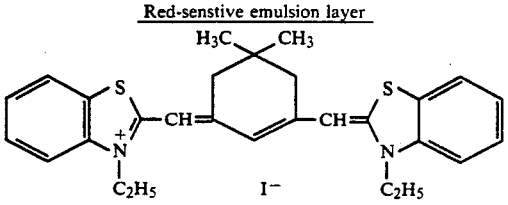

(Amount added = $0.9\times10^{-4}$ moles per mole of silver halide)

To the red-sensitive emulsion layer, the following compound was added in an amount of $2.6\times10^{-4}$ moles per mole of silver halide.

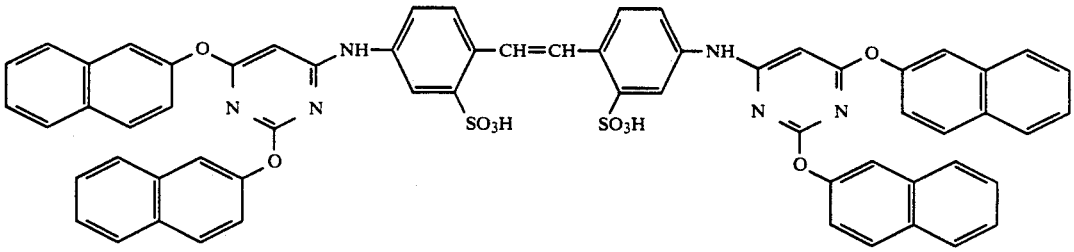

Moreover, to the blue-sensitive, green-sensitive and red-sensitive emulsion layers, 1-(5-methylureido-phenyl)-5-mercaptotetrazole was added in an amount of $8.5\times10^{-5}$ moles, $7.7\times10^{-4}$ moles and $2.5\times10^{-4}$ moles per mole of silver halide, respectively.

The following dyes were used in each of the emulsions as an irradiation resistant dye:

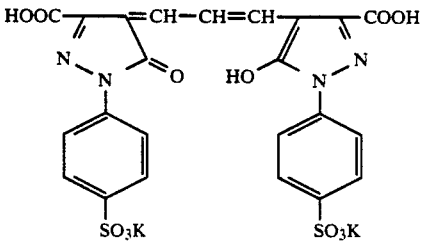

and

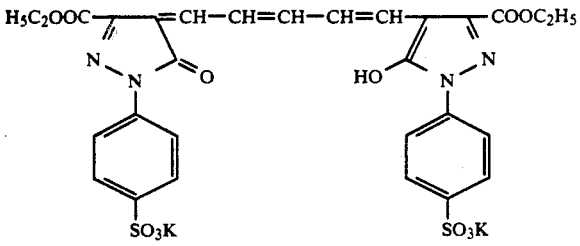

TABLE IV

| Layer | Principal Components | Amount (g/m²) |
|---|---|---|
| 7th layer (protective layer) | gelatin (for dilution) | 1.33 |
| | acrylic acid modified polyvinyl alcohol copolymer (degree of modification = 17%) | 0.17 |
| | liquid paraffin | 0.03 |
| 6th layer | gelatin (for dilution = 0.26; for emulsion = 0.27) | 0.53 |
| (UV absorbing layer) | UV absorber (i) | 0.21 |
| | solvent (k) | 0.08 |
| 5th layer (red-sensitive layer) | silver halide emulsion | 0.23 (Ag) |
| | gelatin (for dilution = 0.29; for emulsion = 0.80; for emulsifier = 0.25 | 1.34 |
| | cyan coupler (l) | 0.34 |
| | dye image stabilizer (m) | 0.17 |
| | polymer (n) | 0.40 |
| | solvent (o) | 0.23 |
| 4th layer | gelatin (for dilution = 0.78; for emulsion = 0.80) | 1.58 |
| (UV absorbing layer) | UV absorber (i) | 0.62 |
| | color mixing inhibitor (j) | 0.05 |
| | solvent (k) | 0.24 |
| 3rd layer (green-sensitive layer) | silver halide emulsion | 0.35 (Ag) |
| | gelatin (for dilution = 0.32; for emulsion = 0.70; for emulsifier = 0.22) | 1.24 |
| | magenta coupler (e) | 0.31 |
| | color image stabilizer (f) | 0.25 |
| | color image stabilizer (g) | 0.12 |
| | solvent (h) | 0.42 |
| 2nd layer (color mixing inhibiting layer) | gelatin (for dilution = 0.84; for emulsion = 0.15) | 0.99 |
| | color mixing inhibitor (d) | 0.08 |
| 1st layer (blue-sensitive layer) | silver halide emulsion | 0.30 (Ag) |
| | gelatin (for dilution = 0.86; for emulsion = 0.70; for emulsifier = 0.30) | 1.86 |
| | yellow coupler (a) | 0.82 |
| | color image stabilizer (b) | 0.19 |
| | solvent (c) | 0.35 |
| substrate | paper laminated with polyethylene (polyethylene situated at teh sdie fo the 1st layer containing a white pigment (titanium oxide) and a bluing dye (Ultramarine Blue)) | |

The same compounds as those used in Example 1 were employed to prepare photographic paper except for the following compounds:

(e) Magenta coupler

-continued

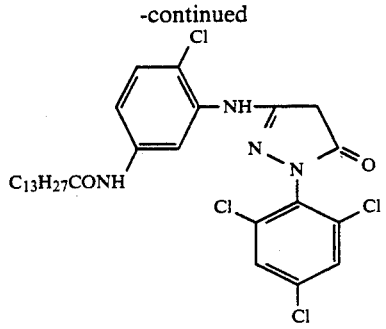

(g) Color image stabilizer

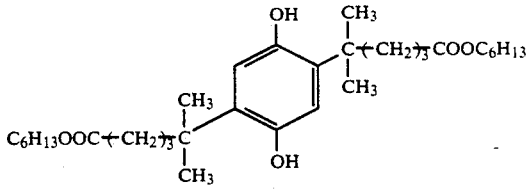

Samples F to J: As in Samples A to E (Example 1), limed gelatin having a calcium content of 3,500 ppm and deionized gelatin having a calcium content of each of these Samples F to J thus prepared was as follows:

| Sample | Calcium Content (mg/m²) |
|---|---|
| F | 31.0 |
| G | 19.2 |
| H | 8.9 |
| I | 3.0 |
| J | 0.4 |

Samples F to J thus prepared were cut into long band-like paper of 82.5 mm in width, they were exposed to light with an autoprinter and then were processed by an autodeveloping machine according to each of the following processing steps shown in Table V. In this Example, the three stabilizing solutions I to III were used.

TABLE V

| Step | Temp. (°C.) | Processing time (sec.) | Volume of tank (liter) | Amount replenished (*) |
|---|---|---|---|---|
| Color development | 35 | 45 | 16 | 13 |
| Bleaching-fixing | 35 | 45 | 10 | 8 |
| Stabilization (1) | 35 | 20 | 4 | Multistage countercurrent |
| Stabilization (2) | 35 | 20 | 4 | |
| Stabilization (3) | 35 | 20 | 4 | (amount replenished: see |

TABLE V-continued

| Step | Temp. (°C.) | Processing time (sec.) | Volume of tank (liter) | Amount replenished (*) |
|---|---|---|---|---|
| Stabilization (4) | 35 | 30 | 4 | Table VI) |
| Drying | 80 | 50 | | |

(*) This was expressed as replenished amount in ml per 1 m of the Sample having 82.5 mm in width.

In the above processing, the volume of the bleaching-fixing solution carried over to the stabilization (1) was 2.5 ml per 1 m of the processed Sample having width of 82.5 mm.

The processing solutions used in these steps had the following compositions:

(Color Development Solution)

| Component | Tank solution (g) | Replenishing solution (g) |
|---|---|---|
| Water | 800 (ml) | 800 (ml) |
| Triethanolamine | 8.0 | 10.0 |
| N,N-diethylhydroxylamine | 4.2 | 6.0 |
| Fluorescent brightener (4,4'-diaminostilbene type) | 3.0 | 4.0 |
| Ethylenediaminetetraacetic acid | 1.0 | 1.5 |
| Potassium carbonate | 30.0 | 30.0 |
| Sodium chloride | 1.4 | 0.1 |
| 4-Amino-3-methyl-N-ethyl-N-(beta-(methanesulfonamido)-ethyl)-p-phenylenediamine sulfate | 5.0 | 7.0 |
| Water (Amount required to obtain 1 liter of the solutions) | | |
| pH (by the addition of KOH) | 10.10 | 10.50 |

(Bleaching-Fixing Solution)

| Component | Tank solution and replenisher (g) |
|---|---|
| Water | 700 (ml) |
| Ferric ammonium ethylenediamine-tetraacetate (dihydrate) | 60 |
| Disodium ethylenediaminetetraacetate (dihydrate) | 4 |
| Ammonium thiosulfate solution (70% w/v) | 120 (ml) |
| Sodium sulfite | 16 |
| Glacial acetic acid | 7 |
| pH | 5.5 |

Water (amount required to obtain 1 liter of the solution)

(Stabilizing solution: Tank Solution and Replenisher)

Stabilizing Solution I: This was prepared by using water containing 82 mg/1 of calcium and 16 mg/1 of magnesium and had the following composition (pH=6.7):

| | |
|---|---|
| Water | 800 ml |
| Aqueous ammonia (27%) | 3.0 g |
| 1-Hydroxyethylidene-1,1-diphosphonic acid | 2.0 g |
| Ammonium sulfite | 3.0 g |
| Fluorescent brightener (4,4'-diamino-stilbene type) | 1.5 g |
| Formalin (37%) | 0.5 g |
| pH | 7.0 |

Water (amount required to form 1 liter of the solution)

Stabilizing Solution II: This was prepared by adding 15 mg/1 of 5-chloro-2-methyl-4-isothiazolin-3-one to the stabilizing solution I.

Stabilizing Solution III: This was prepared by passing the water use to form the stabilizing solution I through a column packed with Na-type strong acidic cation exchange resin (manufactured and sold by MITSUBISHI CHEMICAL INDUSTRIES LTD. under the trade name of Diaion SK-1B) to obtain water having the following composition and then adding the same compound as in the stabilizing solution II in the same amount.

| | |
|---|---|
| Calcium | 1.5 mg/l |
| Magnesium | 0.7 mg/l |
| pH | 7.4 |

Each of Samples F to J was processed according to procedures similar to those in Example 1 using the stabilizing solutions I to III and likewise the estimation of the contamination of Samples, the turbidity of the stabilizing solutions and the proliferation of bacteria or molds therein was effected according to the same manner. The results thus observed are listed in Table VI.

TABLE VI

| Test No. | Sample used | Content of Ca (mg/m$^2$) | Stabilizing Solution | Amount Replenisher (1) |
|---|---|---|---|---|
| 1 (*) | F | 31.0 | I | 200 |
| 2 (*) | G | 19.2 | I | 200 |
| 3 (*) | H | 8.9 | I | 200 |
| 4 (*) | I | 3.0 | I | 200 |
| 5 (*) | J | 0.4 | I | 200 |
| 6 (*) | F | 31.0 | I | 20 |
| 7 | G | 19.2 | I | 20 |
| 8 | H | 8.9 | I | 20 |
| 9 | I | 3.0 | I | 20 |
| 10 | J | 0.4 | I | 20 |
| 11(*) | F | 31.0 | II | 20 |
| 12 | G | 19.2 | II | 20 |
| 13 | H | 8.9 | II | 20 |
| 14 | I | 3.0 | II | 20 |
| 15 | J | 0.4 | II | 20 |
| 16(*) | F | 31.0 | III | 20 |
| 17 | G | 19.2 | III | 20 |
| 18 | H | 8.9 | III | 20 |
| 19 | I | 3.0 | III | 20 |
| 20 | J | 0.4 | III | 20 |

| Test No. | Contamination of Sample | Turbidity of Stabilizing Bath | Molds in Stabilizing Bath |
|---|---|---|---|
| 1 (*) | (−) | (−) | (+) |
| 2 (*) | (−) | (−) | (+) |
| 3 (*) | (−) | (−) | (+) |
| 4 (*) | (−) | (−) | (+) |
| 5 (*) | (−) | (−) | (+) |
| 6 (*) | (+++) | (+++) | (+++) |
| 7 | (+) | (+) | (++) |
| 8 | (+) | (+) | (+) |
| 9 | (−) | (−) | (+) |
| 10 | (−) | (−) | (+) |
| 11 (*) | (++) | (++) | (++) |
| 12 | (+) | (−) | (++) |
| 13 | (−) | (−) | (+) |
| 14 | (−) | (−) | (+) |
| 15 | (−) | (−) | (+) |
| 16 (*) | (++) | (++) | (+) |
| 17 | (+) | (−) | (+) |
| 18 | (−) | (−) | (−) |
| 19 | (−) | (−) | (−) |
| 20 | (−) | (−) | (−) |

(1)This was expressed as replenished amount in ml per 1 m of the sample having 82.5 mm in width.

(*) This means the comparative example.

The ideograms (−) to (+++) appearing in Table VI have the same meanings as those in Table III.

As seen from the results listed in Table VI, the problems on the contamination of Samples, the turbidity of the stabilization bath and the proliferation of molds therein can effectively be eliminated by controlling the amount of calcium in the photographic paper according to the present invention and these effects are further enhanced by simultaneously using 5-chloro-2-methyl-4-isothiazolin-3-one as the antibacterial agent and/or reducing the amount of calcium and magnesium in the stabilizing solution.

EXAMPLE 3

There were prepared multilayered color photosensitive materials (hereunder referred to as Samples K to N) by applying, in order, the following layers, each of which had the composition given below, on a substrate of cellulose triacetate film provided with an underlying coating.

(Composition of the Photosensitive Layer)

In the following composition, each component is represented by coated amount expressed as g/m$^2$, while as to silver halide, the amount was represented by coated amount expressed as a reduced amount of elemental silver, provided that the amounts of sensitizing dyes and couplers are represented by coated amount expressed as a molar amount per unit mole of silver halide included in the same layer.

| | |
|---|---|
| 1st Layer: Halation Inhibiting Layer | |
| Black colloidal silver | 0.18 (Ag) |
| Gelatin | 1.40 |
| 2nd Layer: Intermediate Layer | |
| 2,5-Di-t-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |
| 3rd Layer: First Red-sensitive Emulsion Layer | |
| Silver iodobromide emulsion (AgI content = 6 mole %; average grain size = 0.8 microns) | 0.50 (Ag) |
| Sensitizing dye IX | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| C-2 | 0.146 |
| HBS-1 | 0.005 |
| C-10 | 0.0050 |
| Gelatin | 1.20 |
| 4th Layer: Second Red-sensitive Emulsion Layer | |
| Silver iodobromide emulsion (AgI content = 5 mole %; average grain size = 0.85 microns) | 1.15 (Ag) |
| Sensitizing dye IX | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| C-2 | 0.060 |
| C-3 | 0.008 |
| C-10 | 0.004 |
| HBS-1 | 0.005 |
| Gelatin | 1.50 |
| 5th Layer: Third Red-sensitive Emulsion Layer | |
| Silver iodobromide emulsion (AgI content = 10 mole %; average grain size = 1.5 microns) | 1.50 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| C-5 | 0.012 |
| C-3 | 0.003 |
| C-4 | 0.004 |

-continued

| | |
|---|---|
| HBS-1 | 0.32 |
| Gelatin | 1.63 |
| 6th Layer: Intermediate Layer | |
| Gelatin | 1.06 |
| 7th Layer: First Green-sensitive Emulsion Layer | |
| Silver iodobromide emulsion (AgI content = 6 mole %; average grain size = 0.8 microns) | 0.35 (Ag) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| C-6 | 0.180 |
| C-1 | 0.021 |
| C-7 | 0.030 |
| C-8 | 0.025 |
| HBS-1 | 0.20 |
| Gelatin | 0.70 |
| 8th Layer: Second Green-sensitive Emulsion Layer | |
| Silver iodobromide emulsion (AgI content = 5 mole %; average grain size = 0.85 microns) | 0.75 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| C-6 | 0.035 |
| C-8 | 0.004 |
| C-1 | 0.002 |
| C-7 | 0.003 |
| HBS-1 | 0.15 |
| Gelatin | 0.80 |
| 9th Layer: Third Green-sensitive Emulsion Layer | |
| Silver iodobromide emulsion (AgI content = 10 mole %; average grain size = 1.5 microns) | 1.80 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| C-11 | 0.012 |
| C-1 | 0.001 |
| HBS-2 | 0.69 |
| Gelatin | 1.74 |
| 10th Layer: Yellow Filter Layer | |
| Yellow colloidal silver | 0.05 (Ag) |
| 2,5-Di-t-pentadecylhydroquinone | 0.03 |
| Gelatin | 0.95 |
| 11th Layer: First Blue-sensitive Emulsion Layer | |
| Silver iodobromide emulsion (AgI content = 6 mole %; average grain size = 0.6 microns) | 0.24 (Ag) |
| Sensitizing dye VIII | $3.5 \times 10^{-4}$ |
| C-9 | 0.27 |
| C-8 | 0.005 |
| HBS-1 | 0.28 |
| Gelatin | 1.28 |
| 12th Layer: Second Blue-sensitive Emulsion Layer | |
| Silver iodobromide emulsion (AgI content = 10 mole %; average grain size = 1.0 micron) | 0.45 (Ag) |
| Sensitizing dye VIII | $2.1 \times 10^{-4}$ |
| C-9 | 0.098 |
| HBS-1 | 0.03 |
| Gelatin | 0.46 |
| 13th Layer: Third Blue-sensitive Emulsion Layer | |
| Silver iodobromide emulsion (AgI content = 10 mole %; average grain size = 1.8 microns) | 0.77 (Ag) |
| Sensitizing dye VIII | $2.2 \times 10^{-4}$ |
| C-9 | 0.036 |
| HBS-1 | 0.07 |
| Gelatin | 0.69 |
| 14th Layer: First Protective Layer | |
| Silver iodobromide emulsion (AgI content = 1 mole %; average grain size = 0.07 microns) | 0.5 (Ag) |
| U-1 | 0.11 |
| U-2 | 0.17 |
| Butyl p-hydroxybenzoate | 0.012 |
| HBS-1 | 0.90 |
| Gelatin | 0.70 |
| 15th Layer: Second Protective Layer | |

-continued
| | |
|---|---|
| Polymethylmethacrylate particles (average grain size = 1.5 microns) | 0.54 |
| S-1 | 0.15 |
| S-2 | 0.10 |
| Gelatin | 0.72 |
To each of the layers, there were added a gelatin hardening agent H-1 and a surfactant in addition to the foregoing components.
The structures of the compounds used in this Example are as follows:
U-1
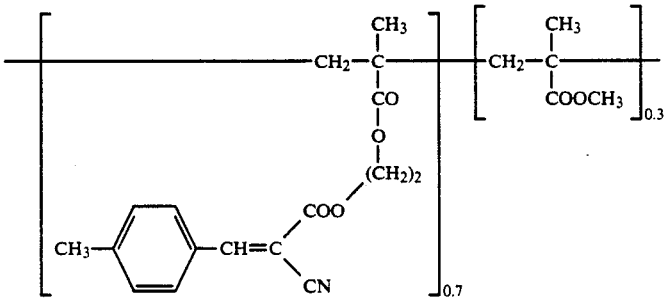
U-2
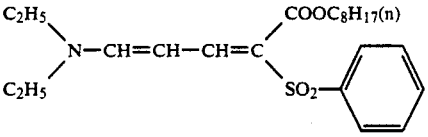
C-1
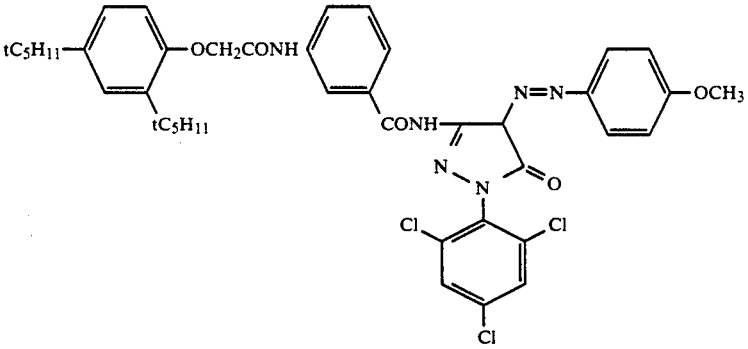
C-2
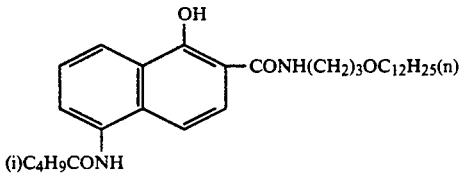
C-3
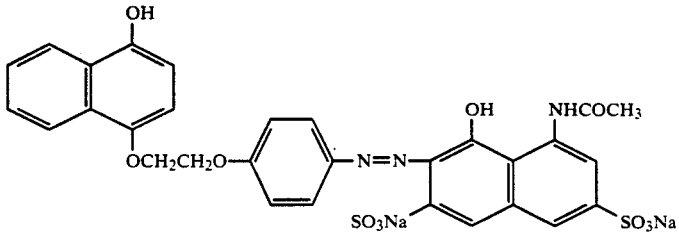
C-4

-continued
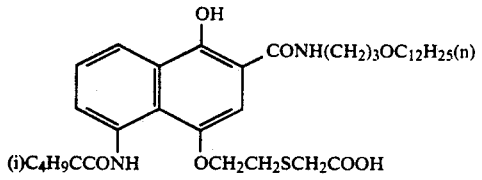
C-5
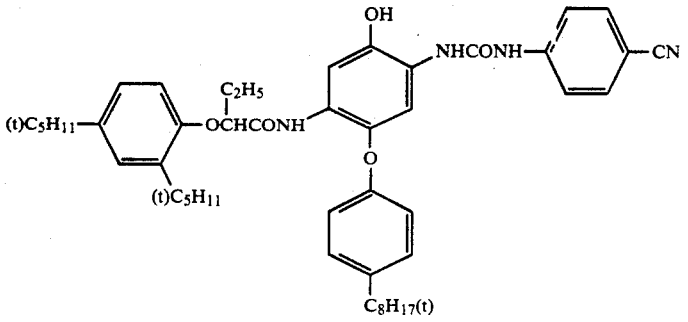
C-6
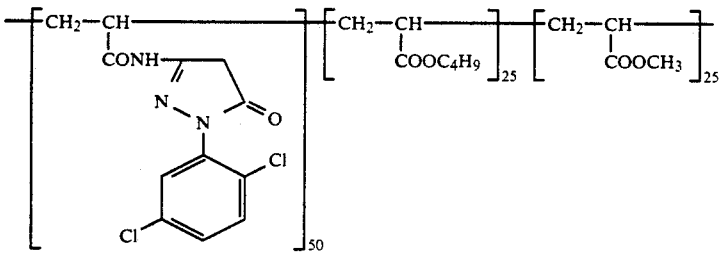
(average molecular weight = 30,000)
C-7
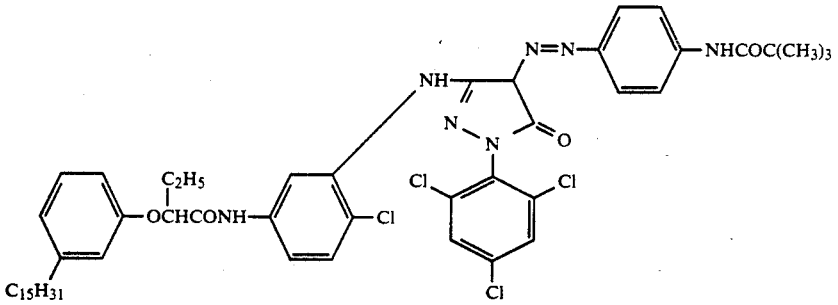
C-8
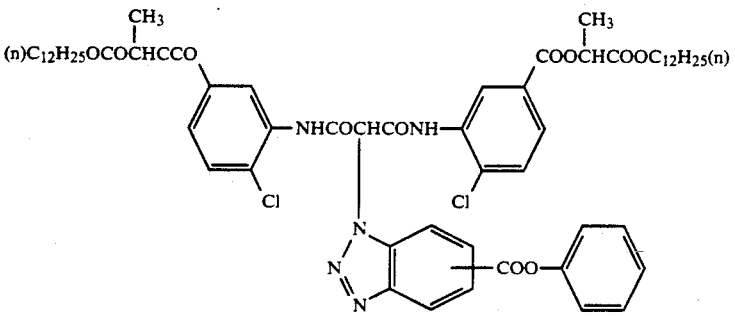
C-9

-continued
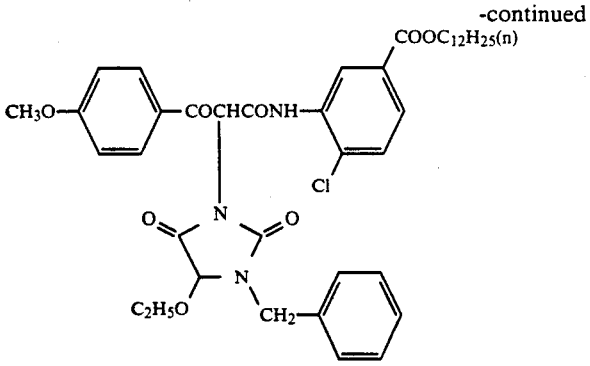
C-10
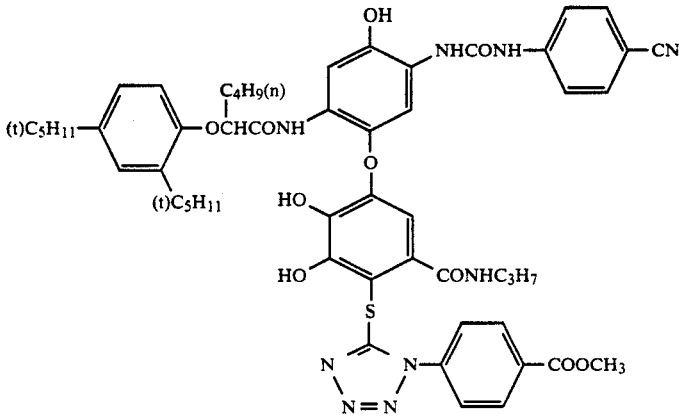
C-11
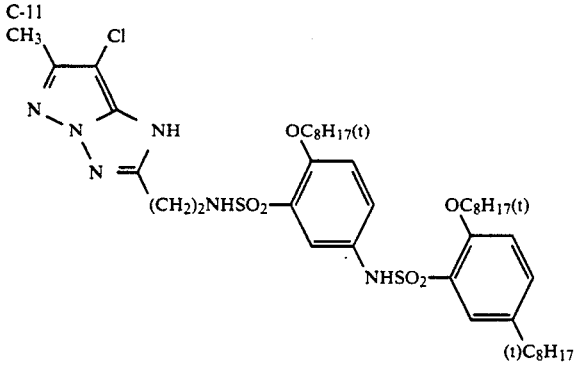
S-1
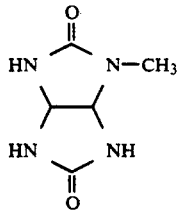
S-2
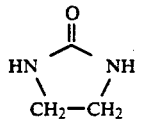
HBS-1
Tricresyl phosphate
HBS-2
Dibutyl phthalate -continued
H-1
$CH_2{=}CH{-}SO_2{-}CH_2CONH{-}CH_2$
$CH_2{=}CH{-}SO_2{-}CH_2CONH{-}CH_2$
Sensitizing Dye II
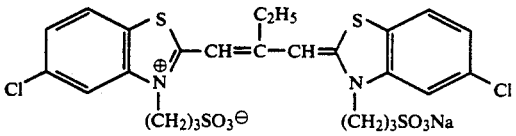
III
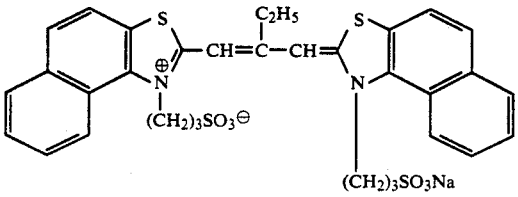
IV
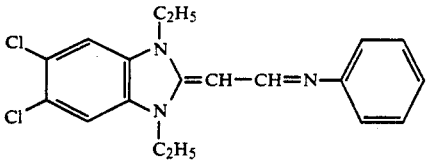
V
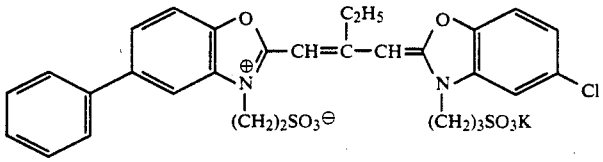
VI
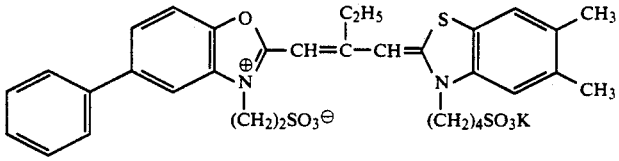
VII
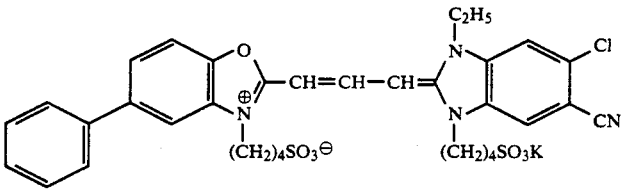
VIII
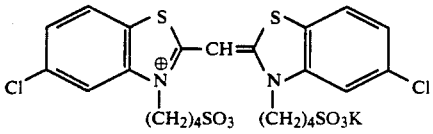
IX -continued

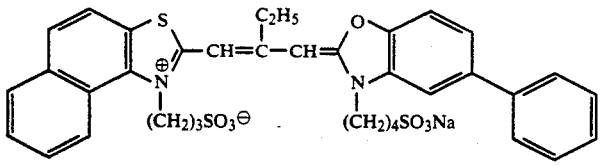

Sample K: Limed gelatin having a calcium content of 2,000 ppm was used as the gelatin component in every layers (calcium content=29.3 mg/m$^2$);

Sample L: The same as Sample K except that deionized gelatin having a calcium content of 40 ppm was used as the gelatin component in the 3rd to the 5th layers (calcium content=20.8 mg/m$^2$);

Sample M: The same as Sample K except that deionized gelatin having a calcium content of 40 ppm was used as the gelatin component in the 3rd to 5th, 7th to 9th and 11th to 13th layers (calcium content=9.7 mg./m$^2$); and Sample N: Deionized gelatin having a calcium content of 40 ppm was used as the gelatin component in every layers (calcium content=0.6 mg/m$^2$).

Samples K to N thus prepared were cut into long band-like films of 35 mm in width. Then, they were exposed to light according to a standard manner. Thereafter, these color photosensitive materials were processed, by an autodeveloping, machine, according to the processing steps shown in Table VII. In the processing, three kinds of washing water IV to VI explained below were employed. Moreover, the amount of the solution carried over from the preceding bath to the water washing process was 2.0 ml per 1 m of the processed photosensitive material having a width of 35 mm.

TABLE VII

| Step | Temp. (°C.) | Processing time (sec.) | Volume of tank (liter) | Amount replenished (*) |
|---|---|---|---|---|
| Color development | 38 | 195 | 8 | 45 |
| Bleaching | 38 | 60 | 4 | 20 |
| Bleaching-fixing | 38 | 195 | 8 | 30 |
| Water washing (1) | 35 | 40 | 4 | Two-stages |
| Water washing (2) | 35 | 60 | 4 | countercurrent system (amount replenished see Table VIII) |
| Stabilization | 35 | 40 | 4 | |

(*) This was expressed as replenished amount in ml per 1 m of the Sample having 35 mm width.

In the foregoing processing steps, water washing steps (1) and (2) were carried out according to countercurrent water washing system from (2) to (1). Each processing solution used had the following composition:

(Color Developing Solution)

| Component | Tank solution (g) | Replenisher (g) |
|---|---|---|
| Diethylenetriaminepentaacetic acid | 1.0 | 1.1 |
| 1-Hydroxyethylidene-1,1'-diphosphonic acid | 2.0 | 2.2 |
| Sodium sulfite | 4.0 | 4.4 |
| Potassium carbonate | 30.0 | 32.0 |
| Potassium bromide | 1.4 | 0.7 |

-continued

| | | |
|---|---|---|
| Potassium iodide | 1.3 (mg) | — |
| Hydroxylamine | 2.4 | 2.6 |
| 4-(N-ethyl-N-beta-hydroxyethylamino)-2-methylaniline sulfate | 4.5 | 5.0 |
| pH | 10.0 | 10.05 |
| Water (amount required to form 1 liter of the solutions) | | |

(Bleaching Solution)

| Component | Tank solution and replenisher (g) |
|---|---|
| Ammonium bromide | 100 |
| Ferric ammonium ethylenediaminetetraacetate | 120 |
| Disodium ethylenediaminetetraacetate | 10.0 |
| Ammonium nitrate | 10.0 |
| Bleaching accelerator (*1) | 2.0 |
| Aqueous ammonia | 17.0 (ml) |
| pH | 6.5 |
| Water (amount required to form 1 liter of the solution) | |

(*1)

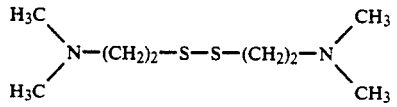

| Component | Tank solution (g) | Replenisher (g) |
|---|---|---|
| (Bleaching-Fixing Solution) | | |
| Ammonium bromide | 50.0 | — |
| Ferric ammonium ethylenediaminetetraacetate | 50.0 | — |
| Disodium ethylenediaminetetraacetate | 5.0 | 1.0 |
| Ammonium nitrate | 5.0 | — |
| Sodium sulfite | 12.0 | 20.0 |
| Aqueous ammonium thiosulfate solution (70%) | 240 (ml) | 400 (ml) |
| Aqueous ammonia | 10.0 (ml) | — |
| pH | 7.3 | 8.0 |
| Water (amount required to form 1 liter of the solutions) | | |
| (Stabilizing Solution) | | |
| Formalin (37% w/v) | 2.0 (ml) | 3.0 (ml) |
| Polyoxyethylene p-monononylphenyl ether (average degree of polymerization = 10) | 0.3 | 0.45 |
| Water (amount required to form 1 liter of the solutions) | | |

(Washing Water: Tank solution and replenisher)
Washing Water IV: This was tap water having the following composition:

| | |
|---|---|
| Calcium | 31 mg/m$^2$ |
| magnesium | 9 mg/m$^2$ |
| pH | 7.2 |

Washing Water V: This was prepared by adding 0.02 g/1 of sodium dichloroisocyanurate to the washing water IV:

Washing Water VI: This was prepared by passing the tap water (Washing Water IV) through a column packed with Na-type strong acidic cation exchange resin (manufactured and sold by MITSUBISHI CHEMICAL INDUSTRIES LTD. under the trade name of Diaion PK-218) to obtain water having the following composition and then adding the same compound as in Washing Water V in the same amount.

| | |
|---|---|
| Calcium | 0.9 mg/l |
| Magnesium | 0.5 mg/l |
| pH | 7.5 |

Each of Samples K to N was processed according to procedures similar to those in Example 1 using Washing Water IV to VI. The processing was carried out at a rate of 30 m/day and was continued for 2 weeks at a rate of 6 days/week. Likewise, the estimation of the contamination of Samples, the turbidity of the washing water and the proliferation of bacteria or molds therein was effected according to the same manner. The results thus observed are listed in Table VIII.

TABLE VIII

| Test No. | Sample used | Content of Ca (mg/m$^2$) | Washing water | Amount Replenisher (1) |
|---|---|---|---|---|
| 1 (*) | K | 29.3 | IV | 300 |
| 2 (*) | L | 20.8 | IV | 300 |
| 3 (*) | M | 9.7 | IV | 300 |
| 4 (*) | N | 0.6 | IV | 300 |
| 5 (*) | K | 29.3 | V | 30 |
| 6 | L | 20.8 | V | 30 |
| 7 | M | 9.7 | V | 30 |
| 8 | N | 0.6 | V | 30 |
| 9 (*) | K | 29.3 | VI | 30 |
| 10 | L | 20.8 | VI | 30 |
| 11 | M | 9.7 | VI | 30 |
| 12 | N | 0.6 | VI | 30 |

| Test No. | Contamination of Sample | Turbidity of water wasing bath | Molds in water washing bath |
|---|---|---|---|
| 1 (*) | (−) | (+) | (+) |
| 2 (*) | (−) | (+) | (+) |
| 3 (*) | (−) | (+) | (+) |
| 4 (*) | (−) | (+) | (+) |
| 5 (*) | (+++) | (+++) | (+++) |
| 6 | (+) | (+) | (++) |
| 7 | (−) | (+) | (+) |
| 8 | (−) | (+) | (+) |
| 9 (*) | (+) | (++) | (++) |
| 10 | (−) | (−) | (+) |
| 11 | (−) | (−) | (−) |
| 12 | (−) | (−) | (−) |

(*) This means the comparative example.
(1) This was expressed as replenished amount in ml per 1 m of the sample having 82.5 mm in width.

The ideograms (−) to (+++) appearing in Table VIII have the same meanings as those in Table III.

As seen from the results listed in Table VIII, the problem associated with the contamination of Samples, the turbidity of the water washing bath and the proliferation of molds therein can effectively be eliminated according to the method of the present invention even if the amount of water is substantially saved.

What is claimed is:

1. A method for processing silver halide photosensitive materials, which materials, prior to processing, include calcium compounds in an amount of not more than 10 mg/m$^2$ on the basis of elemental calcium, said process comprising replenishing a solution used in the water washing process and/or stabilization process in an amount of 1 to 50 times the volume of liquid carried over by the photosensitive material from bath preceding the water washing and/or stabilization process per unit area of the photosensitive material, wherein the amount of calcium and magnesium compounds present in the replenishing solution is not more than 5 mg/l, respectively, on the basis of elemental calcium and magnesium wherein the method effectively inhibits the proliferation of mold and/or bacteria in water washing and/or stabilizing baths.

2. A method for processing as set forth in claim 1 wherein the amount of the replenishers for the water washing process and/or the stabilization process are 3 to 30 times the volume of the liquid carried over from the bath preceding said processes per unit area of the photosensitive material.

3. A method for processing as set forth in claim 1 wherein the amount of calcium compounds in the photosensitive material is provided by using gelatin having a low calcium content when product the photosensitive material.

4. A method for processing as set forth in claim 1 wherein the amount of calcium compounds in the photosensitive material is provided by deionizing gelatin used to form the photosensitive material prior to making the photosensitive material.

5. A method for processing as set forth in claim 1 wherein the concentrations of calcium and/or magnesium compounds in the replenishers for the water washing and/or stabilization processes are reduced to not more than 3 mg/1 on the basis of the weight of elemental calcium and magnesium respectively.

6. A method for processing as set forth in claim 1 wherein the reduction of the amount of the calcium and/or, magnesium compounds in the replenishers is provided by treatment with an ion exchange resin, a zeolite or an apparatus for reverse osmosis.

7. A method for processing as set forth in claim 1 wherein the water washing bath and/or the stabilization bath contain a chelating agent having a stabilization constant with respect to calcium and magnesium of at least 6.

8. A method for processing as set forth in claim 7 wherein the amount of the chelating agent used is in the range of from $3\times10^{-4}$ to $3\times10^{-2}$ moles/1.

9. A method for processing as set forth in claim 1, wherein the water washing process and/or the stabilization process comprise a plurality of baths and the replenishers for the water washing process and/or the stabilization process are replenished in a multistage countercurrent system.

10. A method for processing as set forth in claim 9 wherein the water washing process and/or the stabilization process comprise 2 to 6 baths.

11. A method for processing as set forth in claim 1 wherein pH of the water washing bath is in the range of 5 to 9 and the pH of the stabilization bath is in the range of 4 to 9.

12. A method for processing as set forth in claim 1 wherein the amount of calcium compounds included in the photosensitive material is not more than 3 mg/m$^2$ on the basis of the weight of elemental calcium.

13. A method for processing as set forth in claim 1 wherein the water washing process is carried out as the final step.

14. A method for processing as set forth in claim 1 wherein the method includes both water washing and stabilization processes.

15. A method for processing as set forth in claim 1 wherein the method comprises a stabilizing process without conducting a water washing process.

* * * * *